US006317092B1

(12) United States Patent
de Schweinitz et al.

(10) Patent No.: US 6,317,092 B1
(45) Date of Patent: Nov. 13, 2001

(54) ARTIFICIAL DIELECTRIC LENS ANTENNA

(75) Inventors: David de Schweinitz, Hurst; Thomas L. Frey, Jr., Fort Worth, both of TX (US)

(73) Assignee: Focus Antennas, Inc., McKinney, TX (US)

( * ) Notice: Subject to any disclaimer, the term of this patent is extended or adjusted under 35 U.S.C. 154(b) by 0 days.

(21) Appl. No.: 09/495,076

(22) Filed: Jan. 31, 2000

(51) Int. Cl.[7] ..... H01Q 19/06
(52) U.S. Cl. ..... 343/753; 343/754
(58) Field of Search ..... 343/753, 754, 343/755, 815, 817, 818, 876, 833, 834, 700 MS, 836, 374, 814, 819

(56) References Cited

U.S. PATENT DOCUMENTS

| | | | | |
|---|---|---|---|---|
| 5,243,358 | * | 9/1993 | Sanford et al. | 343/836 |
| 5,257,031 | * | 10/1993 | Scarpetta et al. | 342/374 |
| 5,479,176 | | 12/1995 | Zavrel, Jr. | 342/374 |
| 5,485,167 | * | 1/1996 | Wong et al. | 343/753 |
| 5,767,807 | * | 6/1998 | Pritchett | 342/374 |
| 5,844,525 | | 12/1998 | Hayes et al. | 343/702 |
| 5,870,681 | | 2/1999 | Myer | 455/582 |
| 5,892,483 | | 4/1999 | Hayes et al. | 343/729 |

* cited by examiner

*Primary Examiner*—Don Wong
*Assistant Examiner*—Chuc D Tran

(74) *Attorney, Agent, or Firm*—Beyer Weaver & Thomas LLP

(57) ABSTRACT

An antenna device comprised of dielectric elements, the device having an array of parasitic director elements which coherently focuses energy across the parasitic array. The parasitic elements are spaced less than or equal to one wavelength from each other to provide the coherent focusing, with the array thereby acting like an artificial dielectric lens. An optimal spacing or elemental length might include one-eighth (⅛) to one-quarter (¼) wavelength. A plurality of feed elements is associated with the array and provides incident energy thereon. Reflector elements might also be used to further reflect incident energy from a feed element back across the parasitic array. The various elements are switchably selectable via a switching network which might consist of diodes. The parasitic elements form a lens which provides the directionality of the antenna. The switching network, and associated antenna control, provides the ability to dynamically alter the directionality of the antenna without moving parts. A tuning circuit can be associated with each element, with the tuning circuit being used to make certain elements appear electrically longer. The elements will generally be manufactured to be the same. If the tuning circuit grounds a particular element, then it will function as a director element, and can add to the overall gain of the device. If the tuning circuit makes an element electrically longer, then the element will function as a reflector. This device is useful in various applications, including fixed wireless subscriber terminals, base station to remote platform transmissions, radar tracking, and moving platform transmissions.

47 Claims, 18 Drawing Sheets

ARTIFICIAL DIELECTRIC LENS ANTENNA

FIELD OF THE INVENTION

The present invention relates generally to an artificial dielectric lens antenna, that provides an inexpensive, directionally scannable antenna with a relatively high gain. The antenna uses an array of parasitic elements arranged on a substrate, the elements forming an artificial dielectric lens that is excited by driver elements.

BACKGROUND OF THE INVENTION

An antenna can be any conductive structure that can carry an electrical current. Antennas are generally used to receive or transmit a signal, with the overall design and capabilities of the antenna being a function of the antenna's intended use. Antennas can be designed to receive or transmit signals in all directions, and such devices are referred to as omni-directional antennas. Directional antennas are also commonly used, and are generally used to receive or transmit a signal in a specific direction, or field of view. Directional antennas are designed to provide a higher gain for the signal verses omni-directional antennas. The added gain provided by a directional antenna is useful (and often necessary) in many antenna applications, and hence techniques are continually being developed to enhance the directional capabilities of such antennas, as well as the overall gain provided in relation to such directionality.

In the field of directional antennas there exist today various devices that can produce high gains and/or readily switchable directionality. However, tradeoffs often exist between the capabilities provided. For instance, mechanically driven devices can be designed to produce a very high gain. The most common example would include a dish antenna (i.e. parabolic or otherwise) that is driven by a mechanically steerable device. Such dish antennas are generally large relative to other types of antennas, and the steering system is usually complex. Moreover, the overall system using the device will need to provide enough clearance around the antenna for its physical movement across a range of directionality.

Other devices exist which can provide directionality of the antenna via electronic switching. Examples of such would include "smart" scanned patch array antennas, active element arrays, and the like. Such devices can be designed to provide sufficient gain for certain applications, and will also provide limited directional scanning. However, these devices usually require complex phase shifting electronics to provide beam steering.

Still other devices exist which can provide relatively higher gains, along with directionality. Examples of such devices would include Yagi antennas, unscanned patch arrays, and the like. The Yagi antenna is an example of a fairly high gain array where most of the elements are fed parasitically from one or more driven elements. The Yagi is a relatively inexpensive antenna as the feed network is fairly simple, but dimensional adjustments may be critical in its design and implementation. The phase in the parasitic elements, as used to control the array factor, is controlled by adjusting the lengths and spacings of the elements. This combination of adjustment parameters can be important. The bandwidth of a Yagi antenna is usually only a few percent, yet the antenna can provide a fairly high gain considering its electrical size. The directionality, however, is not generally variable without turning the configured antenna in one direction or another.

Another type of antenna design can provide scannable 360-degree coverage, via electronic switching and the like, between the various elements comprising the antenna. Such antennas generally provide for less gain, and also require more complex switching and feed networks. An example of such an antenna is disclosed in U.S. Pat. No. 5,479,176 issued to Zavrel. Zavrel is characterized by eight electronically switchable radiating directions, with pairs of radiators being used to form parasitic elements, driven elements, and reflectors. Certain drawbacks of Zavrel include its switching complexity, and also its lack of gain on the horizon. For instance, in a useful network, a subscriber terminal (equipped with an antenna) must generally provide 12–18 dBi of gain on the horizon. The antenna of Zavrel only provides approximately 13 dBi of gain at 5 degrees above the horizon, and only 10 dBi of gain on the horizon. The Zavrel array also requires multiple feed points to achieve its gain. This requires splitting the input energy into a minimum of four (4) paths, which incurs an additional system loss. This system loss might range from approximately 2–4 dB, depending upon other factors such as thermal loss, and the like. Thermal loss might amount to 1 dB per switch tree level. Hence a 4-way split such as Zavrel might have would incur approximately 2 dB (or more) of losses, as it uses two (2) divider levels. Thus, in terms of useful gain, the Zavrel array only provides 6–8 dBi of gain.

Zavrel provides certain improvements in wireless network capacity versus terminals using a low gain omni-directional antenna. However, the order of magnitude of improvement in capacity and performance which might be required to justify the substitution of a more complex and expensive directional antenna is not provided by Zavrel. A network operator could not likely justify substitution of a more complex and costly directional antenna for a simple omni-directional monopole antenna unless higher gain can be economically provided.

Accordingly, what is needed in the field of art is an electrically scannable directional antenna with a higher useful gain, particularly on the horizon. The antenna should have a scanning ability with 360 degrees of coverage, fast switching between beam positions, directional self-alignment, and provide for relatively simple installation by a user. The antenna should also provide for alignment control commands that can be provided by an associated command device, or via over-the-air alignment commands, and which results in alignment of the antenna device without mechanical adjustments.

SUMMARY OF THE INVENTION

To achieve the foregoing, and in accordance with the purpose of the present invention, an artificial dielectric lens antenna is disclosed. This present invention provides unique antenna technology that enables production of an inexpensive, yet directionally scannable antenna (via electrical switching, or the like) with a sufficiently high gain (at elevation, and down to the horizon) for use in a variety of telecommunication and other applications.

The antenna uses an array of simple parasitic elements arranged on a substrate and terminated to ground. These elements form an artificial dielectric lens that is excited by driver (or feed) elements placed on the edge of the parasitic array and connected to desired RF signals. The parasitic elements are excited to become directors due to their geometric relationship to the feed elements. Due to their arrangement, electrical coupling between the parasitic elements functions as a lens to focus the energy across the array. Directionality is achieved through the arrangement of the driver elements and is controlled through a simple switching system.

An example antenna structure would include a plurality of feed elements arranged in a circular pattern around a plurality of parasitic elements. In one embodiment, the elements would include simple one-quarter (¼) wave monopoles with inter-element spacing of less than or equal to one wavelength. While any spacing might be used, an optimal spacing has been found to be about one-eighth (⅛) to one-quarter (¼) of a wavelength, with the elements installed on a ground plane. The parasitic array elements are permanently terminated to form a lens. Some of the other elements act as selectable feeds and reflectors to drive the inner parasitic elements. When a single outer element—or adjacent phased pair of outer elements—are selected as the feed, the result is a narrow beam electronically directed towards the opposite side of the aperture. The artificial dielectric lens antenna achieves its high gain by increasing the effective aperture size. Electrical coupling between the parasitic elements (spaced accordingly, at less than ¼ wavelength) causes energy incident directly on, or reflected into the lens, to be refracted coherently (in phase) across the lens. Thus, substantially all of the energy from a single monopole element can be combined in phase, regardless of the initially transmitted direction. In comparison, other types of antennas will provide considerably less energy as combined in phase.

An example arrangement of twelve (12) feed elements would be placed at 30 degree intervals around the circumference of the parasitic array elements. Each feed element would be bordered by at least one reflector element for directing the energy from the feed element across the parasitic array. The parasitic elements would then act to refract the energy across the lens, and in a desired direction, according to the feed and reflector elements which have been activated.

The design can be scaled for frequency by adjusting the relative spacing and height of the feed, reflector, and parasitic elements. The gain and directional resolution (beamwidth and pattern) of the antenna can be adjusted by scaling the size of the device and adding additional elements. In general, an antenna of comparable gain (to prior antennas) can be formed in a relatively smaller and less expensive package due to the parasitic effect between the elements.

The artificial dielectric lens antenna has multiple applications in several industries, including wireless telecommunications, radar, two-way radio, radio beacons, and so forth. The present invention can also be readily applied to any application for scannable smart or semi-smart antennas in which high gain, compact size, and/or fast switching speed is desired. In particular, devices used to transmit and receive a digital signal, e.g. cellular telephones, radio modems, wan data terminals and the like, would benefit from the present invention.

Some applications, such as wireless data networks or fixed cellular systems, benefit greatly in terms of capacity and coverage from having directional antennas but suffer loss of flexibility compared to implementations using omnidirectional antenna systems. These applications would be enhanced by the availability of an inexpensive, solid state scannable directional antenna such as is presented here.

The feed, reflector, and/or parasitic elements of an antenna configuration can also be comprised of elements other than monopole elements, or any combination of such elements. A directionally controllable or unidirectional dielectric lens antenna might also be configured to include, but is not limited to, monopoles, dipoles, folded dipoles, cavities, slots, or combinations thereof, and so forth. The directionally controllable or unidirectional dielectric lens antenna can also be configured with the aforementioned elements, including feed, reflector, and/or parasitic elements, being replaced with cross-polarized elements, which provides two separate cross-polarized apertures, whereby the antenna can be employed in applications where diversity transmission or reception is desired. Examples of such cross-polarized aperture pairs might include a horizontal aperture and a vertical aperture, or a slant 45-degree right aperture and a slant 45-degree left aperture.

According to one aspect of the present invention, a directionally controllable dielectric lens antenna device is provided comprising: at least one switchably selectable feed element forming a feed network; a switching network for selecting the at least one feed element; and an array of parasitic dielectric director elements arranged to coherently focus incident energy from the at least one selected feed element across the array.

According to another aspect of the present invention, a directionally controllable dielectric lens antenna device is provided comprising: a plurality of feed elements arranged to be switchably selected to provide signal coverage in different directions; a switching network for selecting at least one feed element associated with a signal coverage direction; and an array of parasitic dielectric director elements arranged to coherently focus incident energy associated with the at least one selected feed element across the array.

According to still another aspect of the present invention, a directionally controllable dielectric lens antenna device, including unidirectional control, comprising: at least one feed element; and an adjacent array or grid of parasitic dielectric director elements, whereby the at least one feed element is used to excite the adjacent parasitic dielectric director elements which form an artificial dielectric lens to direct the signal from the feed element.

According to still another aspect of the present invention, a static directional dielectric lens antenna device is provided comprising: at least one static feed element; an array of parasitic dielectric director elements arranged to coherently focus incident energy from the at least one static feed element across the array.

These and other advantages of the present invention will become apparent upon reading the following detailed descriptions and studying the various figures of the drawings.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Figure 1:
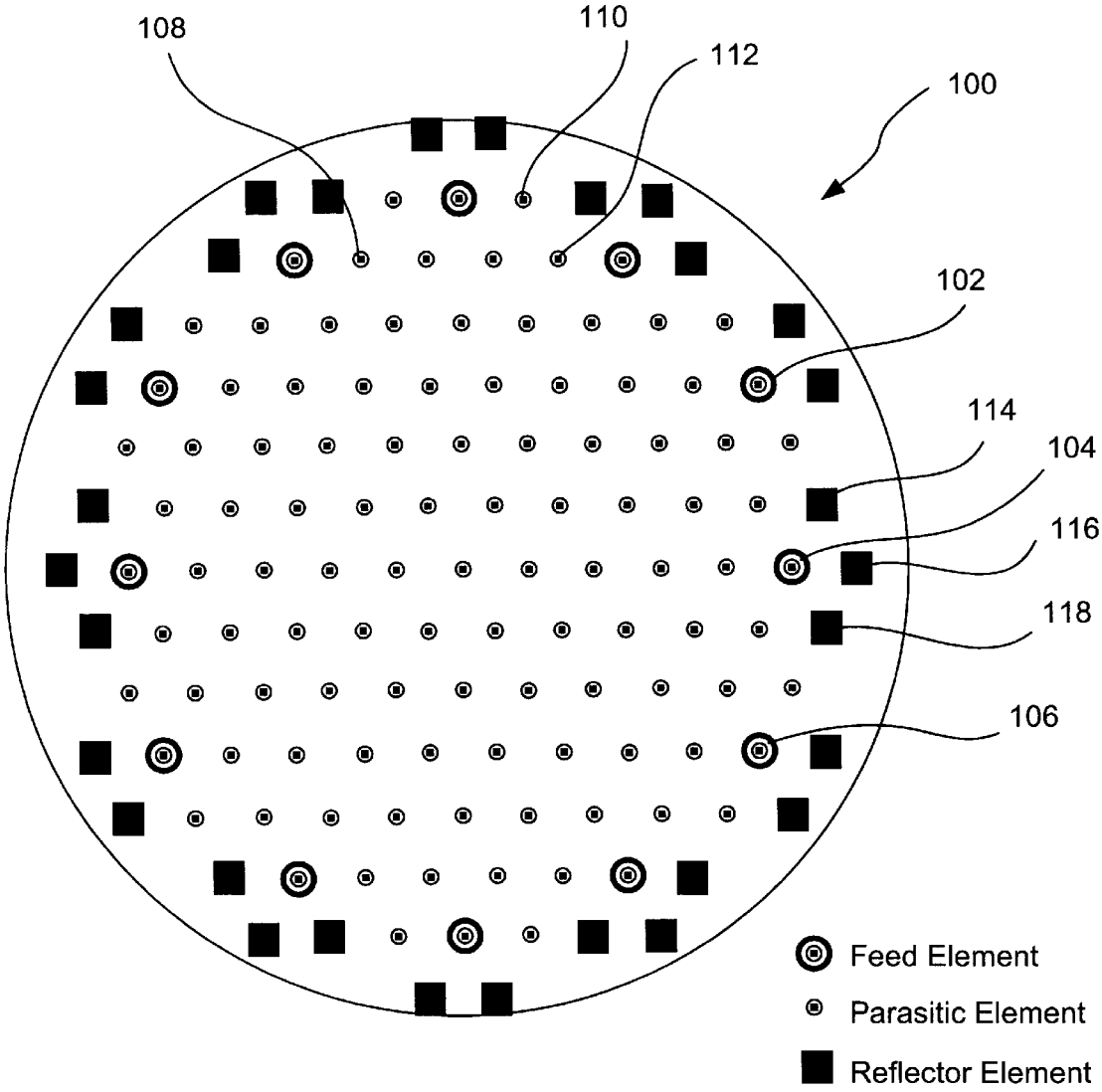
FIG. 1 is an example antenna element arrangement, according to one aspect of the present invention, which uses the parasitic elements to form a dielectric lens.

The present invention provides an antenna structure that uses various elements to provide an "artificial" focusing lens for an electrical signal, thereby increasing the relative gain of the antenna. An example antenna structure would include a plurality of feed elements arranged in a pattern (circular or otherwise) around a plurality of parasitic elements. The elements would include simple one-quarter (¼) wave monopoles with inter-element spacing less than or equal to one wavelength. An optimal spacing has been found to include about one-eighth (⅛) to one-quarter (¼) of a wavelength, with the elements installed on a ground plane. The parasitic array elements are permanently terminated to form a lens. Some of the other elements act as selectable feeds and reflectors to drive the inner parasitic elements. When a single outer element—or adjacent phased pair of outer elements—is/are selected as the feed, the result is a narrow beam electronically directed towards the opposite side of the aperture. The artificial dielectric lens antenna achieves its high gain by increasing the effective aperture size. Electrical coupling between the parasitic elements (spaced accordingly, at less than one-quarter (¼) wavelength) causes energy incident directly on or reflected into the lens to be refracted coherently (or in phase) across the lens.

It should be noted that while certain example antenna configurations are shown below, the present invention is not intended to be limited to such arrangements. Any of a wide variety of elemental combinations might be used within the scope of the present invention. For instance, the elements might include, but are not limited to, elements including: monopoles, dipoles, parasitic monopoles, parasitic dipoles, folded dipoles, slot feed elements, and/or cavity feed elements. Such elements might be used alone, or in combination with each other. Furthermore, any arrangement of the parasitic elements to form a lens for coherently focusing energy from the various configured feed elements is intended to be included within the scope of the present invention.

For instance, the feed, reflector, and/or parasitic elements of an antenna configuration can also be comprised of elements other than monopole elements. A directionally controllable or unidirectional dielectric lens antenna might also be configured to include, but is not limited to, dipoles, folded dipoles, cavities, slots, and so forth. The directionally controllable or unidirectional dielectric lens antenna can also be configured with the aforementioned elements, including feed, reflector, and/or parasitic elements, being replaced with cross-polarized elements, which provides two separate cross-polarized apertures, whereby the antenna can be employed in applications where diversity transmission or reception is desired. Examples of such cross-polarized aperture pairs might include a horizontal aperture and a vertical aperture, or a slant 45 degree right aperture and a slant 45 degree left aperture.

Referring now to FIG. 1, an example (generic) antenna configuration 100 is shown. This circular arrangement uses a plurality of driver (or feed) elements 102, 104, 106, and so forth, located along the outer periphery. In this instance, 12 feed elements are used, and are spaced 30 degrees apart around the circumference of the antenna configuration. A collection of parasitic elements 108, 110, 112, and so forth, are arranged generally in the center of the array. Reflector elements, i.e. 114, 116, and 118 are arranged around each feed element, i.e. 104, to direct the signal from the feed element back towards the parasitic array elements.

The parasitic elements are arranged in a grid, wherein the spacing of the elements is between approximately one-eighth (⅛) and one-quarter (¼) of a wavelength. Each element length would also likely be between one-eighth (⅛) and one-quarter (¼) of a wavelength. In a more general sense, the element spacings and lengths should be less than or equal to one wavelength. The arrangement of the right set of lengths and spacings will produce an optimum result, whereby the phasing of the signals will result in the signals adding coherently. The length and spacing of the elements are thereby chosen and arranged so that the signal acts coherently across the various elements. No specific dimensions are suggested or offered, because such measurements will vary with the different bandwidth requirements needed by different users (with different antennas). To achieve certain performance characteristics, an antenna designer will typically vary the length and spacings until the overall set of characteristics are achieved (with certain tradeoffs often being applied between one characteristic versus another). Moreover, the greater the number of elements, the greater the gains that can be achieved with such an arrangement.

In general, this example antenna configuration uses feed and/or reflector elements along the outer ring of the antenna to form a beam in the opposite direction. The expected beam width at 1.9 GHz for a one-foot diameter antenna is about 25 degrees in azimuth and 35 degrees in elevation, with 13 dBi of gain. The gain and size can be scaled for frequency and desired main beam parameters. For example, a 2-foot diameter antenna at 1.9 GHz has been shown to narrow the beam to 12 degrees azimuth and 17 degrees of elevation, but provides 19 dBi of gain. In either example, an identical example design is used, only the number of elements and the overall size of the device vary.

A switch, such as an on-antenna low power switch, or a series of pin diodes, or the like, can be used to select the radiating elements. The switch can be passive, and control line(s) can be used to select the appropriate radiating element. The reflector elements can either be "physically longer" to provide reflection, or the "same size" and inductively loaded to provide reflection. Physically longer reflectors can be diode switched to ground, with the element thereby acting as a reflector. Alternatively, the element can be left open depending upon the radiating element selected, with the reflector element becoming RF transparent and not interfering with the pattern from another radiating element. Same size reflectors are switched between an inductive lead or ground, depending upon the radiating element selected. When coupled to an inductive lead, the same size element acts as a reflective element. When coupled to ground, the same size element acts as an additional parasitic director. Since there are no conditions in which the reflector elements require a signal feed, there is no need to provide signal splitting with the present invention. Accordingly, this simplifies the feed and switching network of the present invention.

The example antenna is comprised of a grid of simple one-quarter (¼) wave monopole elements with inter-element spacing of about one-eighth (⅛) to one-quarter (¼) of a wavelength, with the elements typically being installed on a ground plane. The parasitic array (or director) elements are permanently terminated and form a lens. Director elements are often configured to be slightly shorter than reflector elements. The outer elements thereby act as selectable feeds and reflectors to drive the inner parasitic elements.

Figure 2:
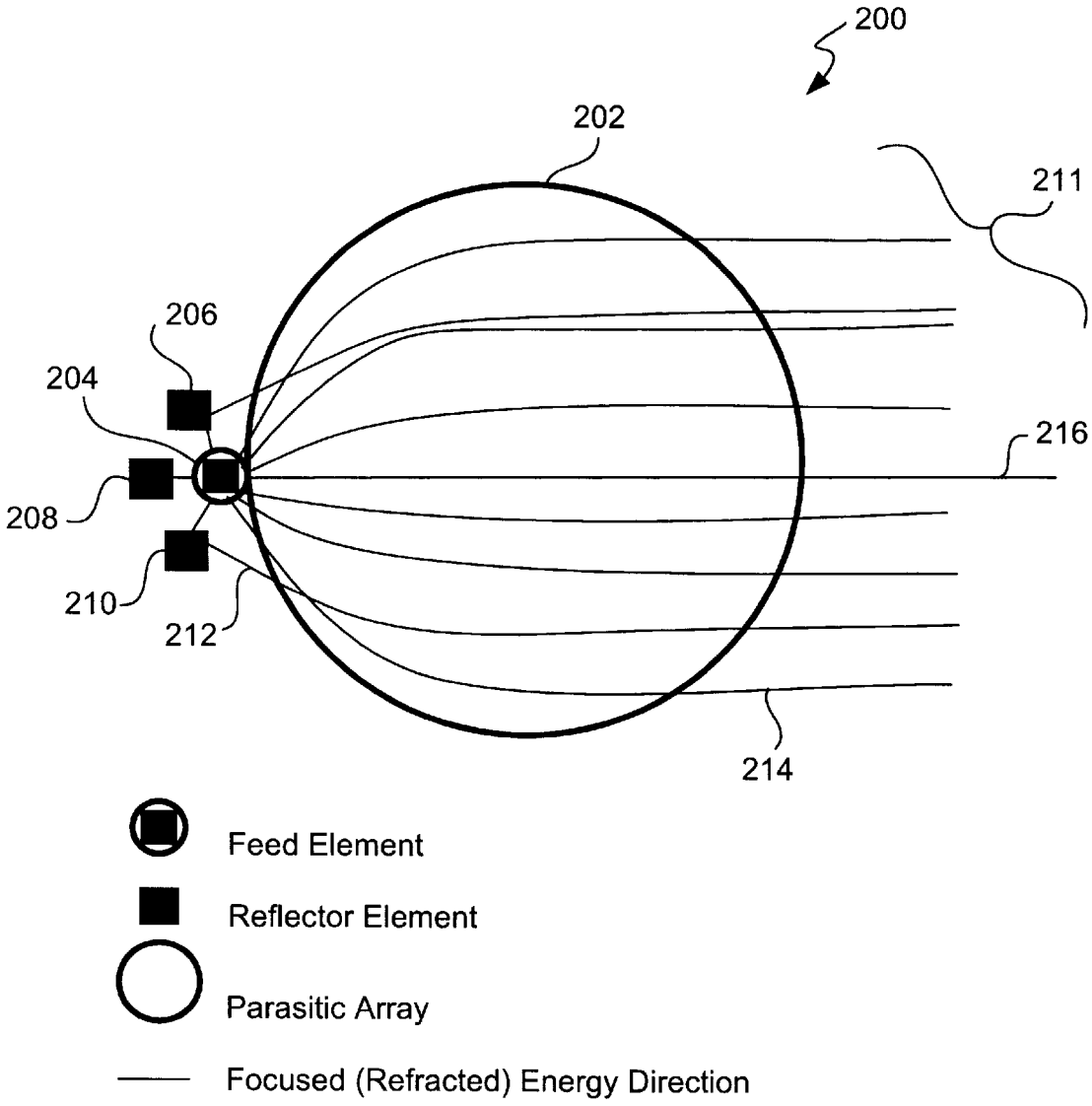
FIG. 2 shows an example antenna element arrangement, with the resulting focused energy directed across the parasitic lens, according to one aspect of the present invention.

Referring now to FIG. 2, a representative diagram 200 shows the effect of the various elements on an input signal. A parasitic array 202 is shown proximity located to a feed element 204. A set of reflector elements 206, 208, and 210 are shown partially surrounding the feed element 204. A generalized set of energy directions 211 are further detailed by the plurality of lines, for example 212, 214, and 216. Energy radiating from the feed element is directed (and focused) across the parasitic array 202. Energy is also reflected off the reflector elements to be directed across the parasitic array. As such, when this single outer element (as shown), or an adjacent phased pair of outer elements (not shown) are selected as the feed, the result is a narrow beam electronically directed towards the opposite side of the aperture. The artificial dielectric lens antenna achieves its high gain by increasing the effective aperture size. Electrical coupling between the parasitic elements causes substantially all energy incident directly on, or reflected into the lens, to be refracted coherently (in phase) across the lens. In comparison, less than 50% of the energy is combined in phase for a Yagi type of directional antenna. As a result, the present invention provides higher gain, and much better front-to-back ratio as compared to a Yagi type of antenna, which might have more than twice the length. The present antenna design also allows discrete electronic scanning of the array over 360 degrees by selecting various feed elements located at various positions around the lens.

Figure 3:
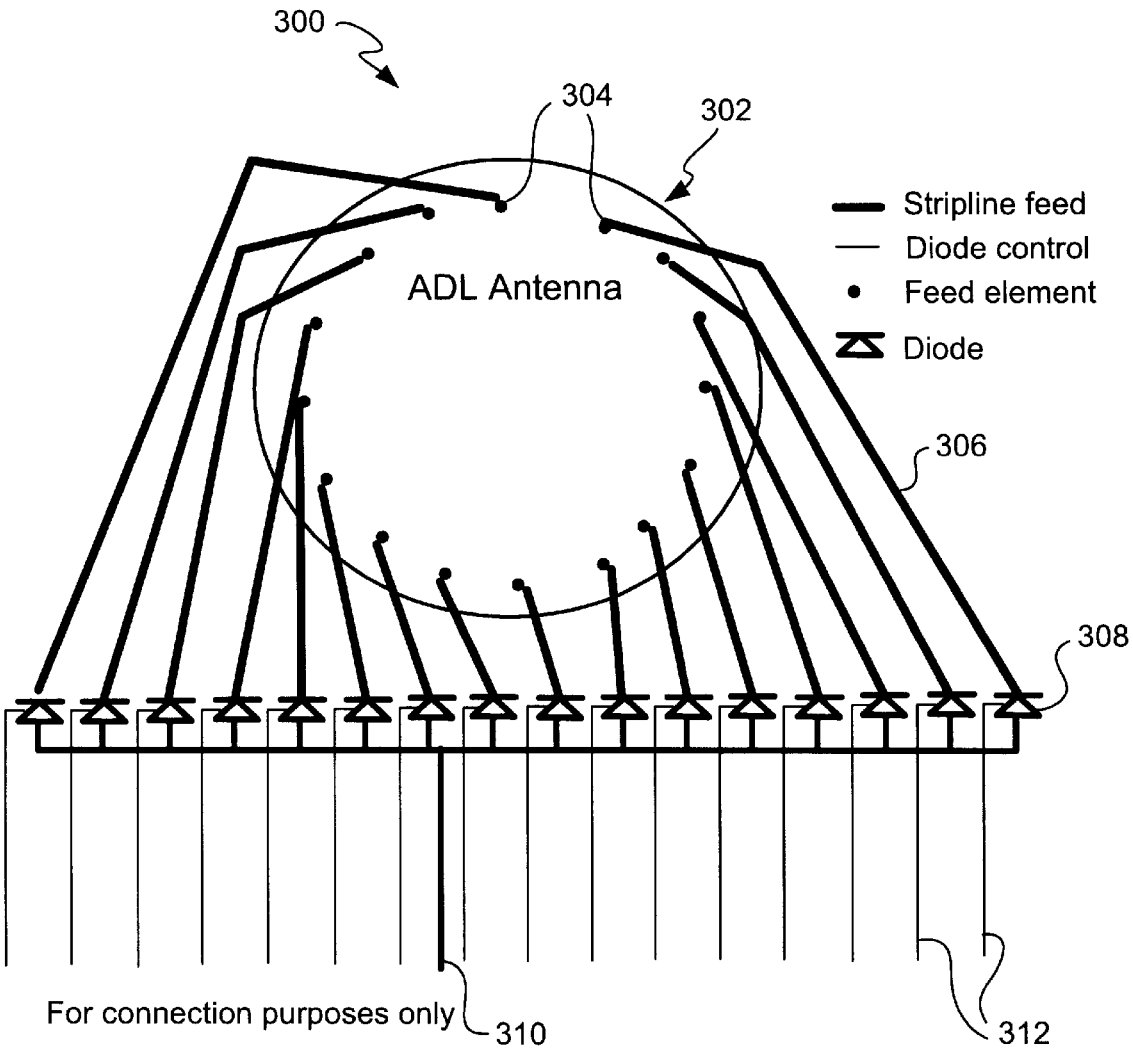
FIG. 3 shows an example antenna element arrangement, with connection lines to each feed element, according to one aspect of the present invention.

Referring now to FIG. 3, a representative antenna configuration 300 is shown with an example switching network for selecting the various feed elements. The antenna configuration 302 is shown supporting a plurality of feed elements. In this instance, 16 elements are shown spaced approximately 22–23 degrees apart around the periphery. Each feed element is connected to a representative stripline feed 306. The stripline feed 306 leads to a simple switch or diode 308. The main feed path 310 is shown switched between the various feed elements 304. A series of associated control lines 312 are shown leading to the switches or diodes, as required. The control lines 312 are coupled to control circuitry in order to readily adjust the direction of focus of the antenna without physically moving the unit.

The simple switch or diode series (or switching device) is used to select the appropriate feed/reflector combination. A feed and its associated reflectors (if any) can be electrically transparent (open) when not selected, thereby allowing for a single switch configuration. The switching device can be comprised of a series of diodes, or similar switching devices on an integrated chip (IC), or the like. Either approach provides an economical method of implementation. The connections from the radiating antenna element to the switch are strip-line (or some variant). Each element, whether it be a feed, reflector, or parasitic element, can be as simple as a metal pin—depending upon the frequency and power requirements of the antenna.

It should also be noted, that while certain switching networks and the like have been illustrated in association with feed elements to provide directionality, the present invention is also readily applicable to simpler static antenna configurations, wherein a single feed element is used with the parasitic lens elements.

Figure 4A:
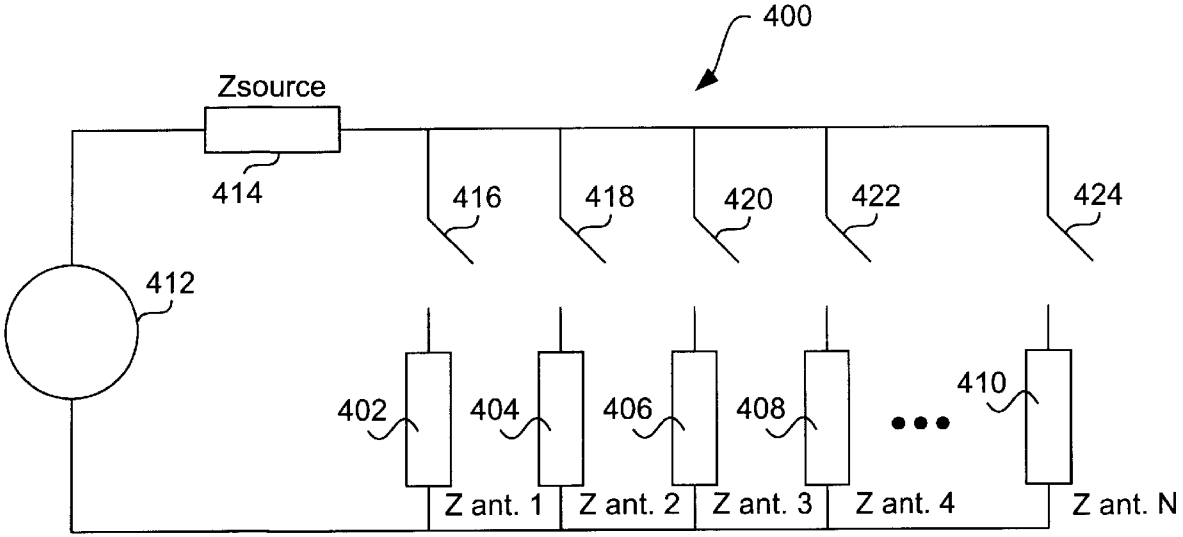
FIG. 4A shows a feed distribution schematic, according to one aspect of the present invention.
Figure 4B:
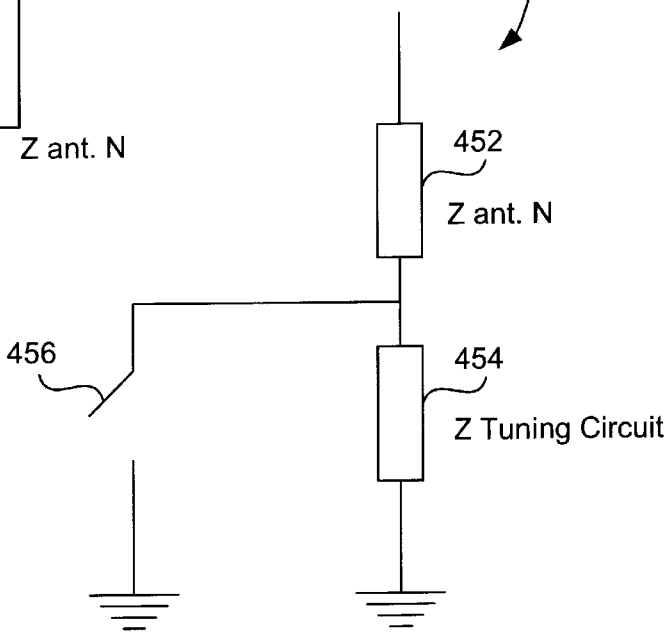
FIG. 4B shows a feed distribution schematic to increase the gain for electrically long elements (or reflectors or feeds), according to one aspect of the present invention.

Referring now to FIGS. 4A and 4B, a distribution schematic is shown of one example of a feed network that could be associated with the artificial dielectric lens antenna of the present invention. This is but one example of how the feed network might be implemented. A perfectly efficient (ideal) feed network would provide all of the power to a single antenna feed. The artificial dielectric lens antenna requires that only one feed element be selected, which allows for a closer approximation of an ideal feed network than multiple feed designs, such as Zavrel.

For the antenna to work optimally, the reflector elements need to be slightly longer than the feed elements that are slightly longer than the parasitic elements that form the lens.

FIG. 4A is an example of a feed network in which the selected driver antenna element is selected with a feed switch (416, 418, 420, 422, 424). The switch might be a series of PIN diodes, stripline, or the like. An example of such a distribution schematic is found in "SPDT Switch Serves PCM Applications," by Raymond W. Waugh, Microwaves & RF, January 1994, Page 111. This type of feed network would be used when the elements are physically different sizes. The feed elements are all terminated to a common point in a simple parallel circuit. The full signal power into the antenna is directed into the selected antenna driver element. Since the driver and reflector elements are physically longer than the parasitic elements, unselected feed and reflector elements on the opposite side of the device from the currently selected element, if any, will cause a disruption to the antenna pattern. For this reason this form of the device is most applicable when no feed or reflector elements will be on the opposite side of the array. One example application includes antennas designed to be scanned less than 180 degrees, including fixed devices with no scanning capability. Another example application would include an array with the feeds in the center, such as the one shown in FIG. 700 below. Another example would be applications where the aforementioned disruption to the pattern (i.e. of having feed elements across the lens) could be tolerated.

Disruption in the gain pattern such as described in the above paragraph can be eliminated by making all of the elements (reflector, feed and parasitic) the same physical size and then electrically "lengthening" the driver and reflector elements using a tuning circuit. The feed circuit would be very similar to the one represented in FIG. 4A but with each of the feed elements from FIG. 4A (402, 404, 406, 408, 410) replaced by the circuit in figure 4B. FIG. 4B shows a circuit that allows the driver element to be tuned to an "electrically longer" state when selected. When the tuning switch (456) is closed, the tuning circuit is circumvented. The element is thereby grounded and becomes a parasitic element. These additional director elements will incrementally increase the effective size of the device as compared to the implementation in FIG. 4A, thus improving gain. When the feed element is selected (e.g. feed switch 416 in FIG. 4A is closed for element 1), the tuning switch (456) is opened and the electrical length of the element is increased. The ability to alter the apparent electrical length of the elements prevents pattern disruption due to interference from feed and/or reflector elements in the beam path.

This tuning circuit is not a complex one to design or build. Each switch (feed, feed tuning, and reflector tuning) for a specific selected direction can be driven from a single logic trace and are closed and opened at the same moment. The tuning circuit is a small reactive load that in most cases can be etched directly on the circuit board. Reflector elements do not require signal feed and therefore do not require a feed switch.

Still another feed implementation might be provided (as similar to the switches shown in FIG. 4A), wherein a diode is used to switch the opposite side reflectors and feed elements to an open circuit. In such a case, the reflectors do not serve to disrupt the pattern. However, for generally the same implementation and switching costs, they also do not provide any of the gain advantages described in FIG. 4B of turning the opposite side reflector and feed elements into directors.

The artificial dielectric lens antenna can be scaled for frequency by adjusting the spacing and height of the feed, reflector, and/or parasitic elements. The gain and directional resolution of the antenna can be adjusted by scaling the size of the device and/or adding additional elements. As established earlier, the parasitic elements function like a lens for directing the energy from the feed elements. As a result, the bigger the associated parasitic array, the more advantageous the relative results. For instance, the feed element acts like a pole that provides energy, wherein the energy then gets focused across the parasitic array. Depending upon the arrangement, more energy can be more finely focused based upon the arrangement of the lens, feed elements, and reflectors.

Figure 5A:
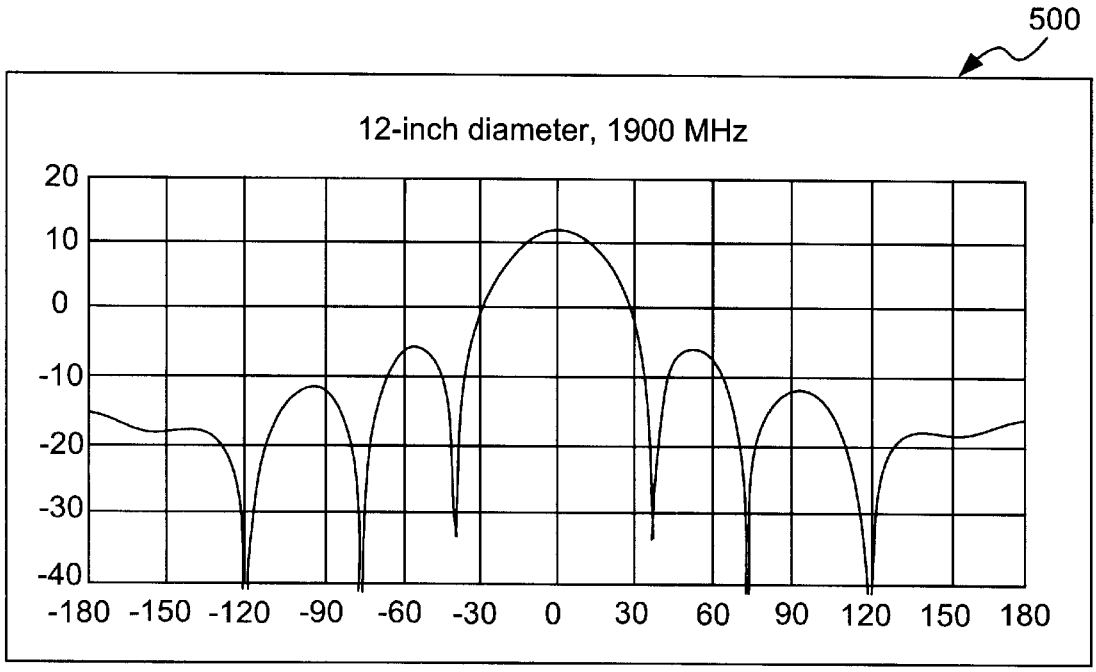
FIG. 5A shows a representative gain plot of a 12-inch diameter antenna at 1900 MHz, according to one aspect of the present invention.
Figure 5B:
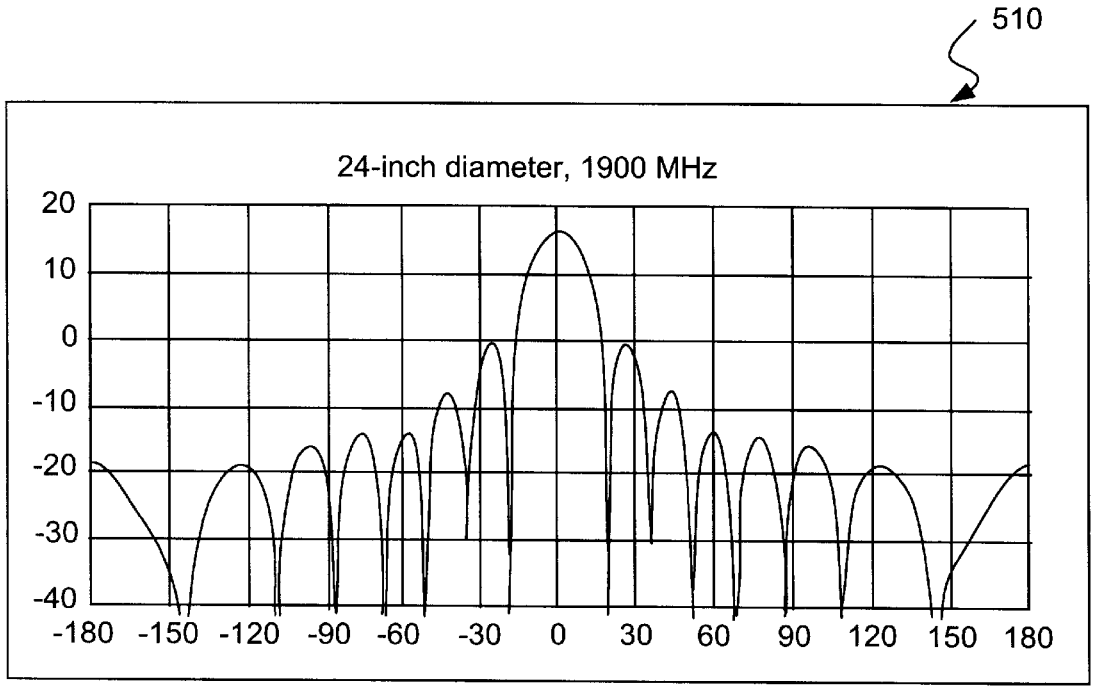
FIG. 5B shows a representative gain plot of a 24-inch diameter antenna at 1900 MHz, according to one aspect of the present invention.
Figure 5C:
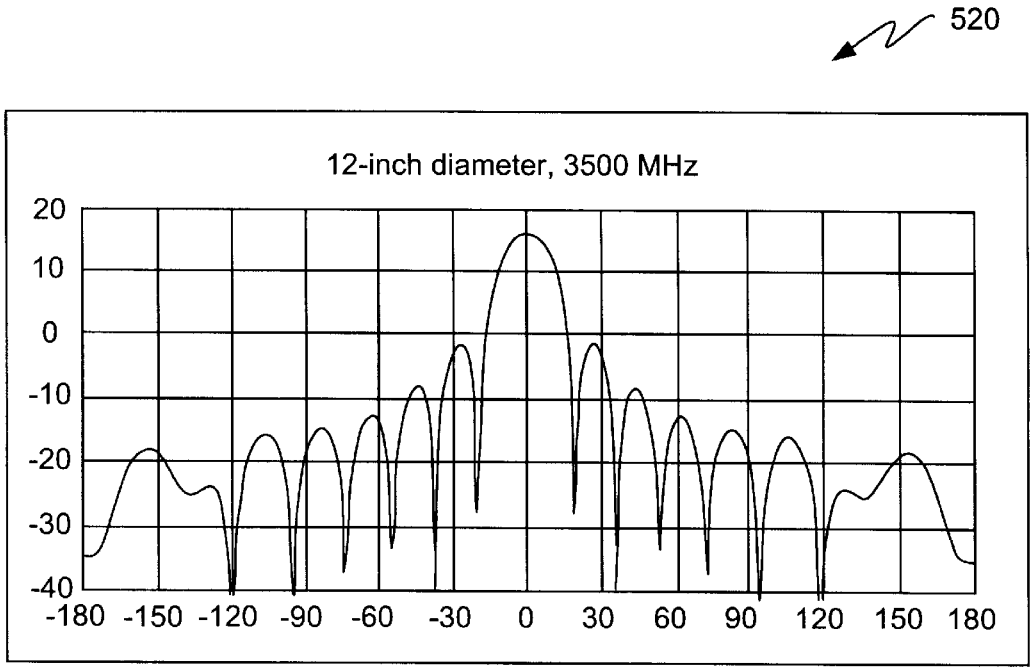
FIG. 5C shows a representative gain plot of a 12-inch diameter antenna at 3500 MHz, according to one aspect of the present invention.

Referring now to FIGS. 5A–5C, certain representative gain patterns are shown with the gain (dBi) plotted on the vertical axis versus the azimuth angle in degrees on the horizontal axis. In general, the azimuth beamwidth is proportional to the inverse of the radius of the antenna in wavelengths. In general, the elevation beamwidth is inversely proportional to the square root of the radius of the antenna in wavelengths. The first pattern (FIG. 5A) shows the pattern results 500 for a 12-inch diameter antenna, operating at 1.9 GHz, at 30 degrees azimuth and 45 degrees elevation, and having a gain of 15 dBi peak, and 14 dBi on the horizon. FIG. 5B shows the pattern results 510 for a 24-inch diameter antenna, operating at 1.9 GHz, at 15 degrees azimuth and 30 degrees elevation, having a gain of 19.5 dBi peak, and 18.5 dBi on the horizon. FIG. 5C shows pattern results 520 for a 12-inch diameter antenna, operating at 3.5 GHz, at 17 degrees azimuth and 32 degrees elevation, having 19.0 dBi peak, and 18.0 dBi on the horizon. Notably, the 24-inch antenna provides a gain increase of approximately 4.5 dBi over the 12-inch antenna. The 3.5 GHz 12 inch antenna provides a 4 dB gain improvement compared to the 1.9 GHz antenna of the same size. All patterns show gain of the antenna itself without accounting for the loss of a feed network which may typically be about 1 to 2 dB.

These plots serve to show that for a given diameter (or size) of antenna, the gain of the present implementation is relatively better than that of the prior art. Designing a required gain is also a function of the scalability of the antenna. Generally, the bigger the parasitic array, then the larger the gain. However, the gain pattern will change depending upon number and arrangement of the elements, along with the frequency of operation. The designer can thereby tradeoff manufacturing complexity and size to achieve certain desired performance characteristics. For instance, the present invention might trade away the desired smaller size for required increases in gain.

The bandwidth of the artificial dielectric lens antenna is greater than 10% of the center operating frequency. For example, if the center frequency is 1.9 GHz, then the device will have greater than 1.9 MHz of useful bandwidth. This translates into an operational frequency range in excess of 1.8–2.0 GHz, covering the entire allocated Personal Communications Services, PCS, spectrum as allocated by the FCC.

Figure 6:
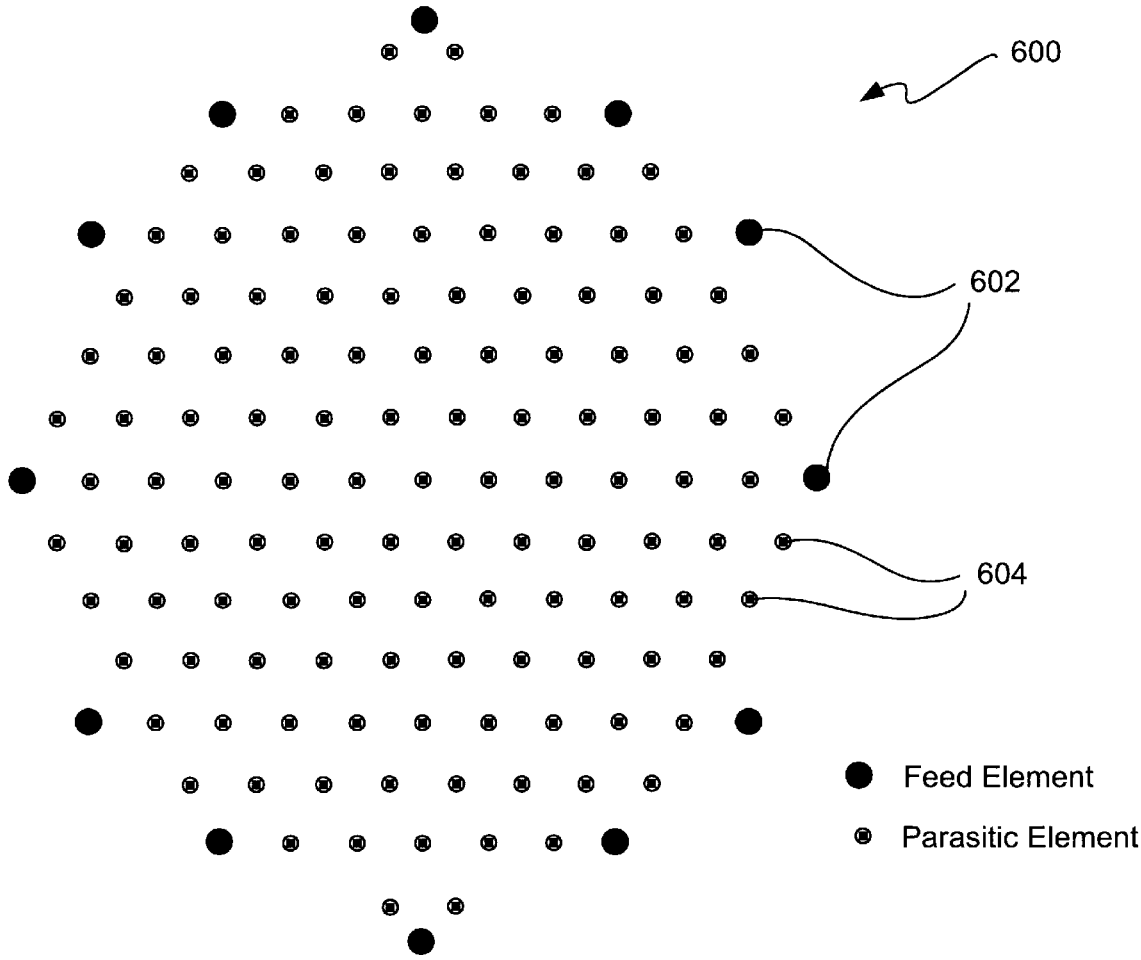
FIG. 6 shows an example antenna element arrangement without reflector elements, according to one aspect of the present invention.

Referring now to FIG. 6, it is also possible to utilize the artificial dielectric lens antenna without the reflector elements. FIG. 6 shows a representative configuration of elements 600, as similar to FIG. 1, but without the reflector elements. Certain feed elements 602 are shown arranged around the periphery of a circular antenna configuration. Parasitic elements 604 are shown arranged in the central portion of the configuration for focusing energy coming from the feed elements. Without the reflector elements, there is generally a 2–4 dB gain reduction, and a 4–6 dB reduction in front-to-back ratio. An advantage of this configuration, however, is that control of the reflector elements is not required, and hence the cost/overhead of such associated circuitry would not be required.

Figure 7:
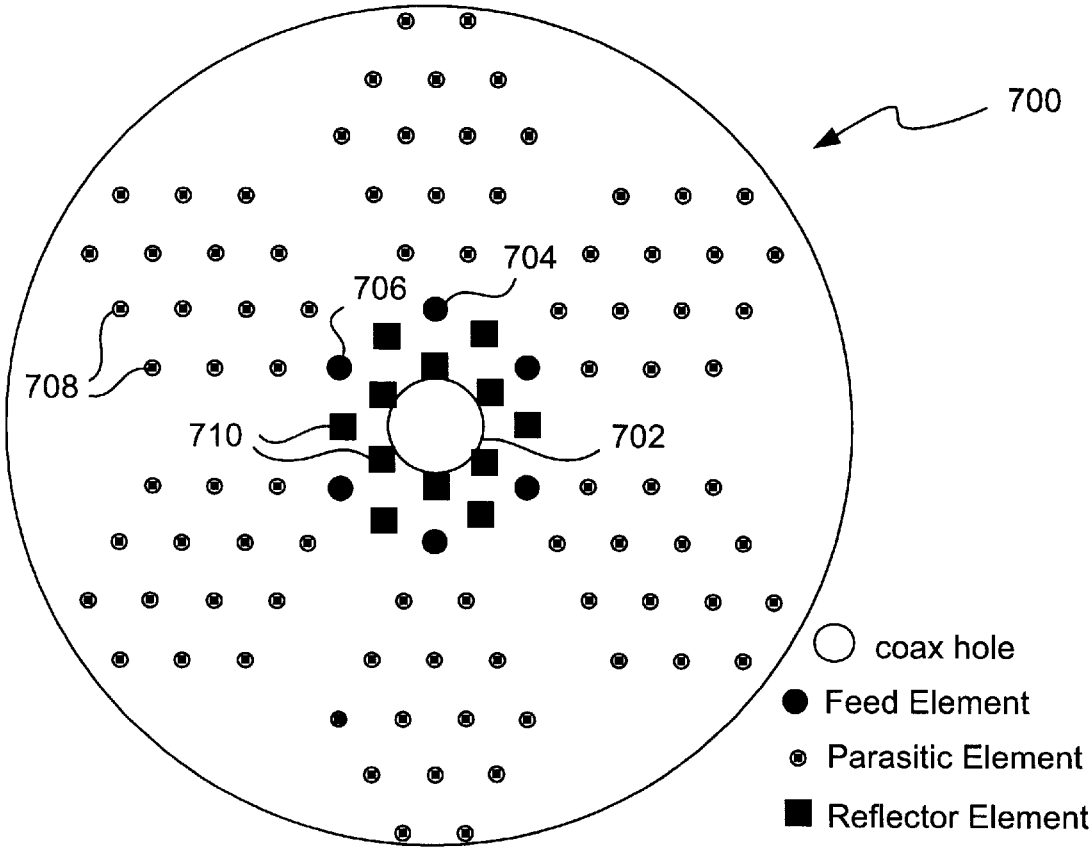
FIG. 7 shows an example antenna element arrangement which might be used in a base station application, with deployment of the parasitic arrays in different directions around the antenna, according to one aspect of the present invention.

Another aspect of the present invention would be to employ the artificial dielectric lens antenna in a single feed configuration, or as multiple single feed antennas, configured back-to-back. One representative configuration 700 is shown in FIG. 7. In this particular implementation, six artificial dielectric lens antennas are deployed back-to-back. A coax cable hole 702 is shown in the center of the configuration. A series of feed elements 704, 706, and so forth are shown configured around the hole 702. Each feed element has an array of parasitic elements (i.e. 708) associated with it. Reflector elements 710 are also shown associated with each feed element, arranged to generally reflect the signal across each associated parasitic array. Deployment in this fashion has been found to reduce the gain from a standard equivalently sized artificial dielectric lens antenna by approximately 6 dB. However, in addition to eliminating the need to tune the reflector elements, this particular implementation incorporates the hole 702 through the antenna center.

Figure 7A:
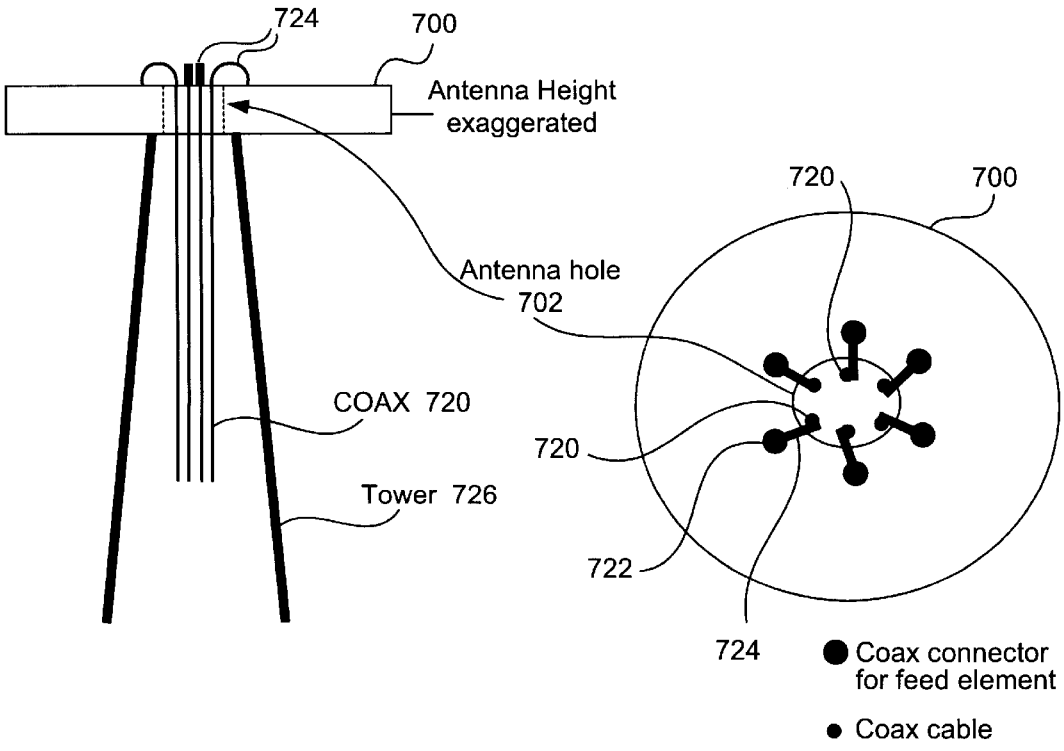
FIG. 7A shows the example antenna arrangement of FIG. 7 being used in an elevated mounting situation, with coaxial cables connecting to the feed elements through the central hole.

For certain deployments, this configuration can simplify mounting of the artificial dielectric lens antenna on a tower, or the like, as well as facilitate running the coaxial cable feed lines in a manner that will not restrict the antenna's field of view. Referring now to FIG. 7A, an example connection configuration is shown. A side view of the antenna 700 is shown (with the height or thickness exaggerated, for example purposes). The central hole 702 is shown accommodating at least one coaxial cable 720 down through the center of the antenna 700, which is suspended (or elevated) via a tower 726, or the like. The cables 724 connect to the feed elements via a coaxial connector 722. Still other connectors 724 might be used to route the signal from the coaxial connector 722 to the associated coaxial cable 720. Cellular phone base stations are one type of application that might benefit from this mounting configuration. Any related tradeoffs associated with the overall gain can be compensated for by making the device larger.

Figure 7B:
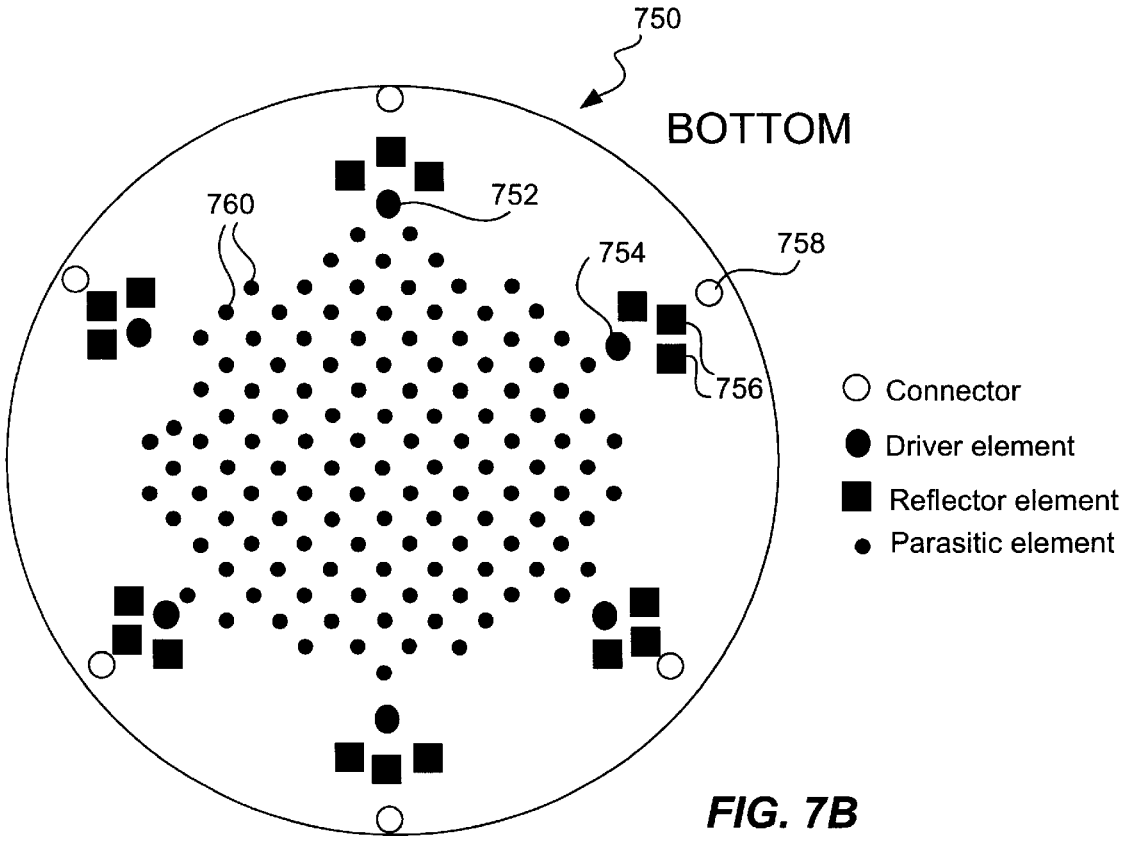
FIG. 7B shows still another example antenna arrangement, according to one aspect of the present invention, with elements arranged similar to FIG. 1.
Figure 7C:
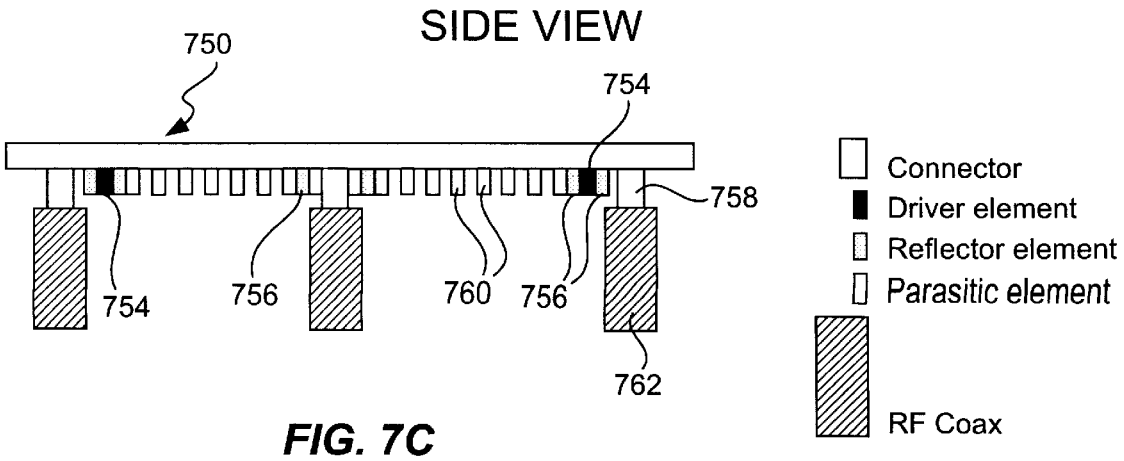
FIG. 7C shows a side view of FIG. 7B, with coaxial connections leading to each feed element around the periphery.

Another possible configuration for implementing a wireless base station antenna is shown in FIGS. 7B and 7C, with both bottom and side views being shown. As similar to FIG. 1, the antenna 750 is shown with certain feed elements 752, 754 and so forth around the periphery. An array of parasitic elements 760 is arranged in the center of the antenna. Each feed element has associated with it certain reflector elements 756, which are typically arranged in a semicircular fashion to reflect energy back towards the collection of parasitic elements, which act as a dielectric lens. A connector 758 is used to receive a signal from an incoming feed path, such as a coaxial cable, or the like. FIG. 8B shows the attachment of an RF coaxial cable 762 to the connector element 758. In this particular implementation, the invention with multiple feed networks can be used to replace a plurality of conventionally deployed wireless base station antennas. An antenna configured as shown can be used to serve the needs of multiple sectors co-located on the same tower. One particular advantage associated with such aggregation is that numerous conventional antennas might be eliminated, along with their associated wind loads. This might serve to reduce both antenna and tower costs.

Figure 8A:
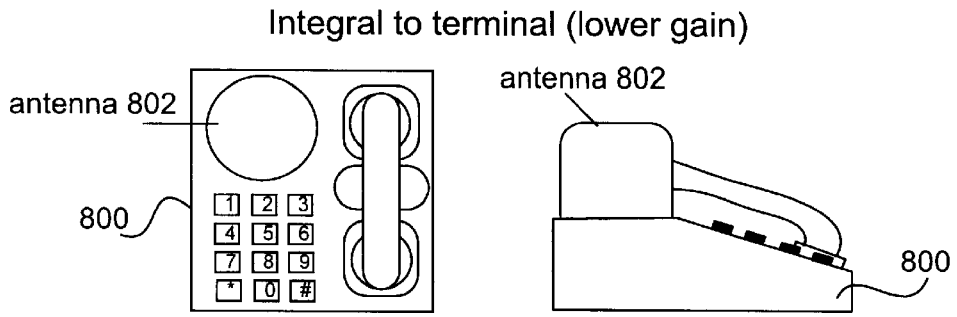
FIGS. 8(A)–(C) shows example antenna size and integration techniques, according to aspects of the present invention.
Figure 8B:
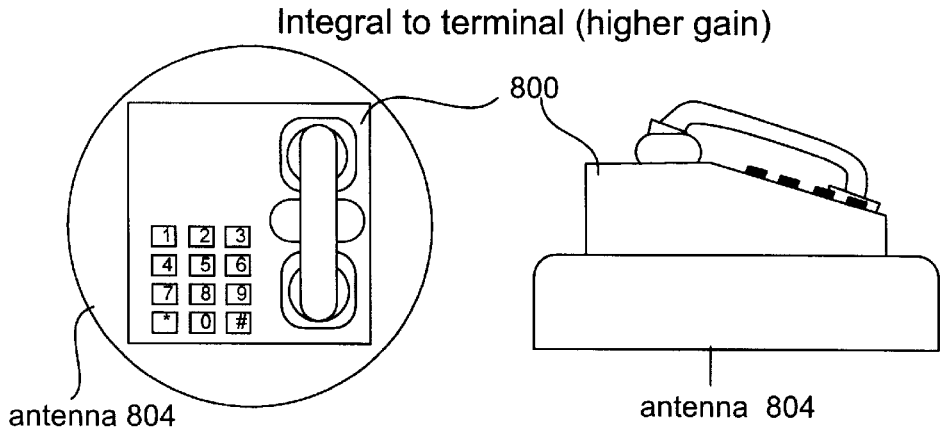
Figure 8C:
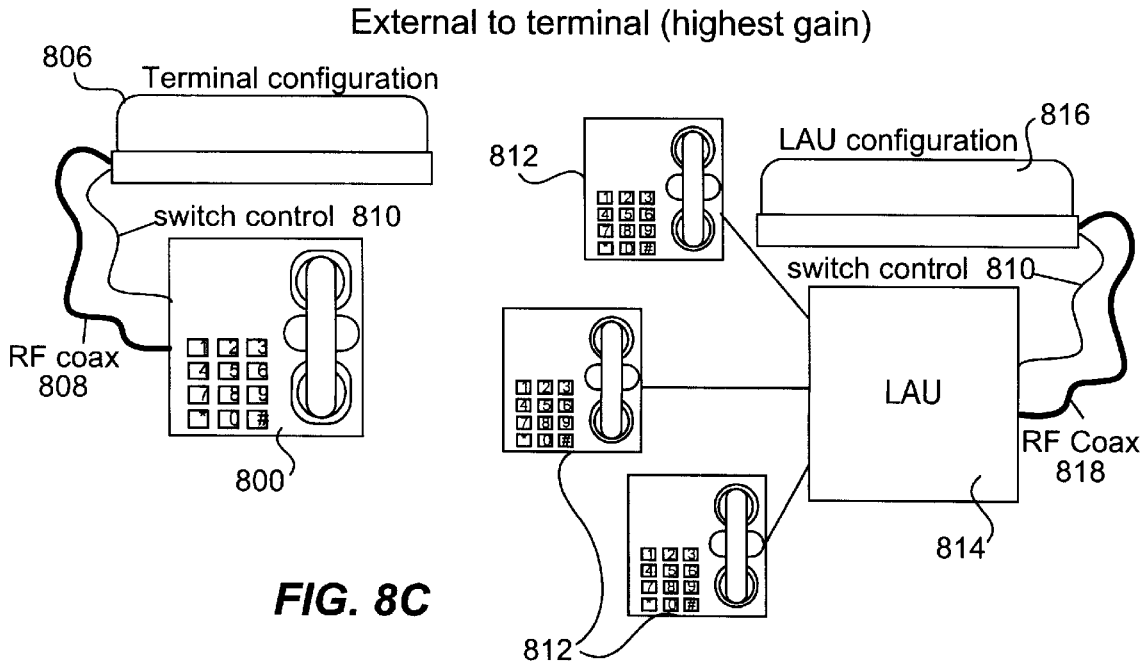

Referring now to FIGS. 8 (A)–(C), certain representative versions of the artificial dielectric lens antenna are shown, as applied to wireless terminal deployment configurations. FIG. 8(A) shows a first example of a phone or communication terminal 800 with an antenna device 802 connected integrally with the terminal. The shown configuration provides certain advantages over the prior art, but will have a lower relative gain due to size constraints associated with integration of a conveniently sized antenna with the terminal device. FIG. 8(B) shows a larger and relatively less convenient antenna 804, which is also integrally associated with the terminal device 800. This configuration will provide a relatively higher gain than that of FIG. 8(A). FIG. 8(C) shows an antenna 806 that is configured to be external to the terminal device 800. Such external location allows for the antenna to be any serviceable shape or size. An RF coaxial connection 808 (or the like) can be used to transfer signals to and from the terminal 800. A separate switch control connection 810 can be used to supply directional control to the antenna 806. FIG. 8(C) also shows a plurality of terminals 812 coupled to a Line Access Unit or LAU. An LAU is a terminal device that provides wireless transmission and reception and is locally connected to provide this wireless link to one or more voice or data units such as phones or computer terminals. The LAU is coupled to the antenna device 816 via an RF coaxial connection 818, and a switch control connection 810. This configuration will provide the highest relative gain, as compared to the FIGS. 8(A) and 8(B).

Figure 9:
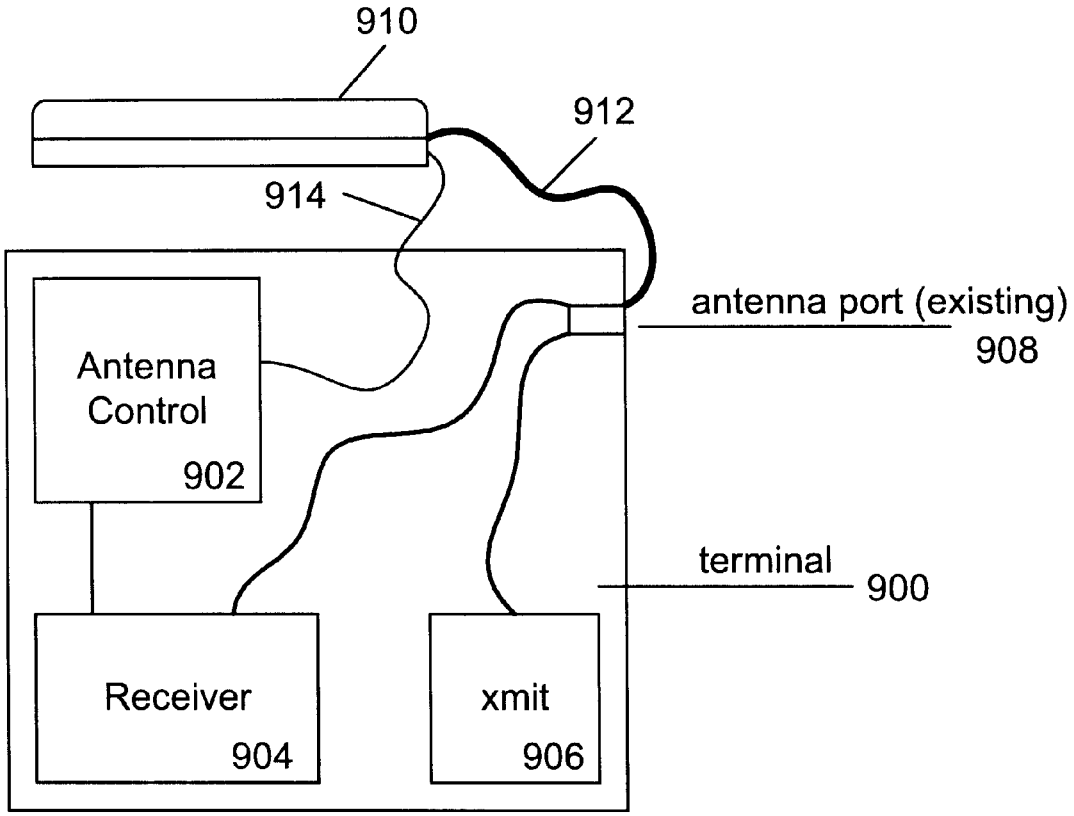
FIG. 9 shows a block diagram of an example device with a self-contained antenna control, according to one aspect of the present invention.

Referring now to FIG. 9, a block diagram is shown of certain representative components which might be used in association with an artificial dielectric lens antenna, as configured external to a terminal. In this configuration, the terminal device 900 includes an antenna control unit 902, a receiver unit 904, and a transmitter unit 906. An antenna port 908 (existing or otherwise) is used to connect the antenna 910 to the terminal unit 900. The antenna control 902 is coupled to the receiver unit 904 in order to guide the directional reception of the antenna 910. An RF coax connection 912 is shown to direct signals to and from the receiver and transmitter units 904 and 906. A switching control connection 914 is shown between the antenna control 902 and the antenna 910. This particular configuration is economical and efficient in that the antenna unit 910 utilizes the receiver unit 904, which in this case is integrally associated with the terminal 900. No other separate receiver unit needs to be associated with the antenna unit 910 in order to achieve directional control.

Figure 10:
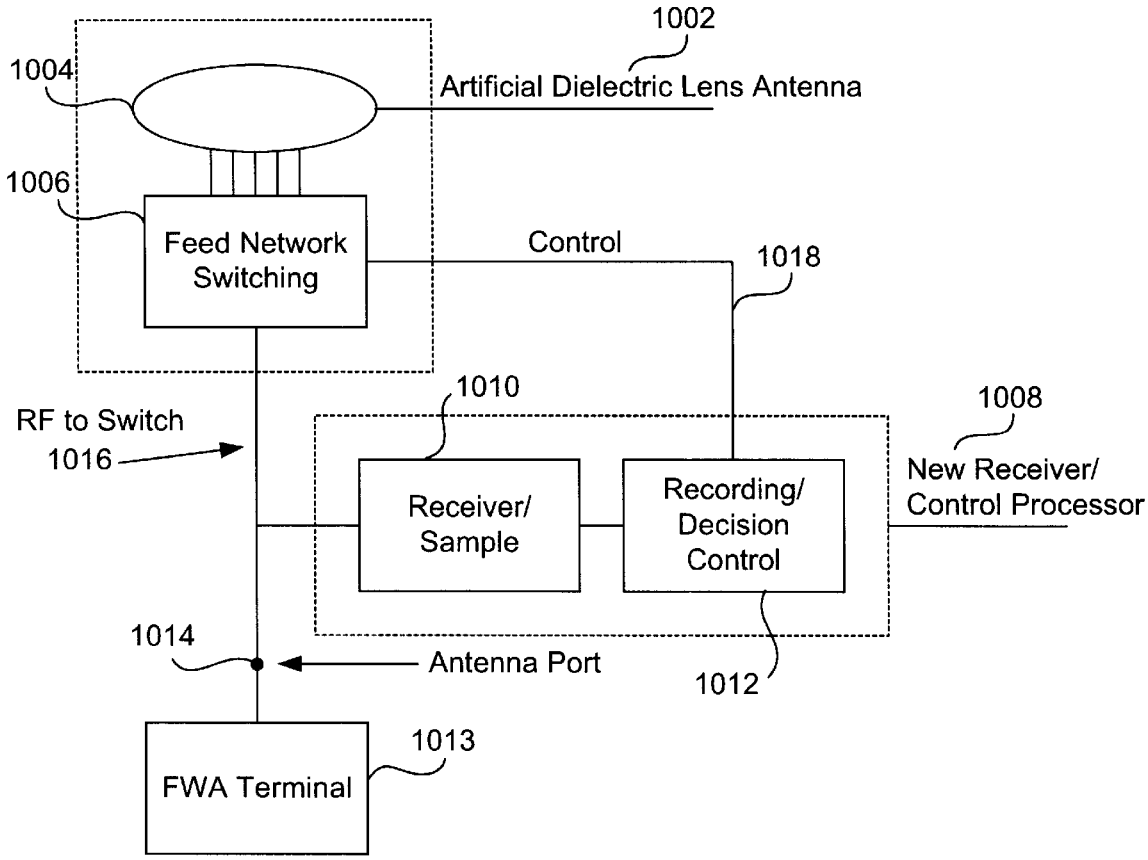
FIG. 10 shows a block diagram of an example device with external antenna control, according to one aspect of the present invention, e.g. a completed device that only connects to the RF antenna port of an existing device directly replacing the original low gain omni-directional antenna.

Referring now to FIG. 10, a block diagram is shown of certain representative elements which might be associated with an artificial dielectric lens antenna which uses a receiver device external to a terminal unit. The artificial dielectric lens antenna 1002 is shown having an array 1004 and an associated feed network switching unit 1006. An external (or new) receiver and control processor unit 1008 is shown including a receiver or sampler 1010. The unit 1008 also includes a recording or decision control device 1012. The control device 1012 is coupled to the feed network switching unit 1006 via a control connection 1018. An RF connection 1016 from the processor unit 1008 to the feed network switching 1006 is shown to further facilitate direction control over the antenna unit 1002. An FWA terminal 1013 is shown having an associated antenna port 1014. The configuration, which includes both the receiver/control processor 1008 and the artificial dielectric lens antenna 1002, is coupled to the associated antenna port to provide signal transmission and reception with directional control. In this configuration, the present antenna can be connected to any existing omni-directional device without modification of the existing equipment.

Figure 11:
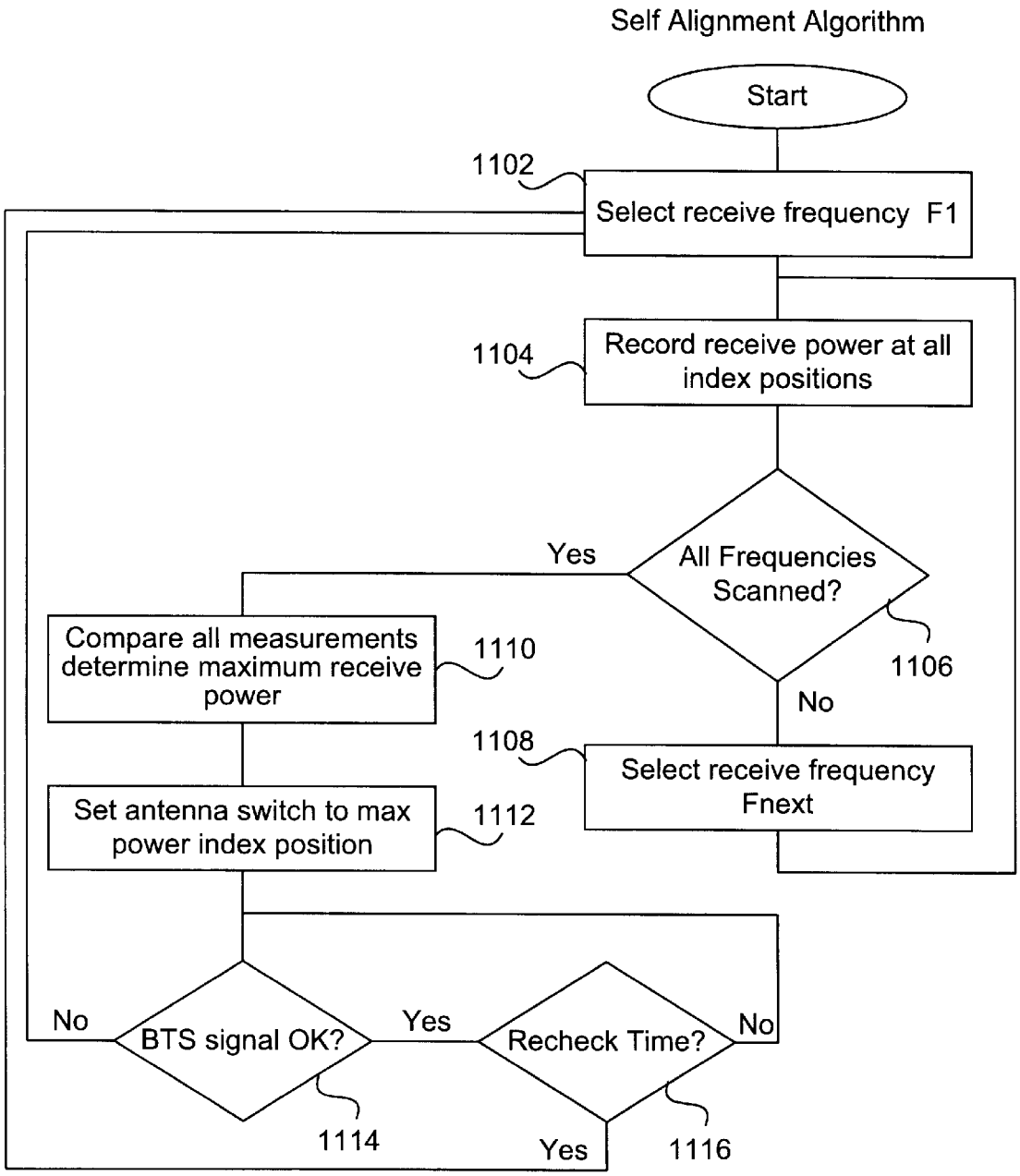
FIG. 11 shows certain representative steps which can be used, according to one aspect of the present invention, for self-alignment of the antenna.

Referring now to FIG. 11, a flowchart is shown of certain representative steps that might be used to align the directional antenna described according to the present invention. According to example configurations shown above, the antenna will have certain feed elements at different index positions, i.e. every 30 degrees if twelve (12) feed elements are used. The algorithm described will step around the various positions and use the strongest base station for receipt of signal information. This series of steps, referred to herein as a "self-alignment algorithm" starts at block 1102 by selecting a first receive frequency F1. The next step 1104 shows recording the received power for each index position selected. A conditional block 1106 checks if all the frequencies have been scanned. If not, then step 1108 selects the next receive frequency (Fnext) and passes control back up to step 1104 to cycle through all the index positions. Once all the frequencies have been scanned, step 1110 compares all the measurements to determine the maximum received power. Step 1112 next sets the antenna switch to the maximum power index position. Terminal devices in a network are, in general, required to constantly monitor the base station paging or control channels to determine if a new message is applicable to that specific terminal (for example, to receive an incoming call or page). Conditional block 1114 utilizes the signal data from the constant monitoring to determine if the base station is operational. If the base station faults and goes off that air, conditional block 1114 is invalid. Then the process alignment starts again via routing of control to step 1102. If the BTS signal is still valid, then conditional block 1116 utilizes a counter based on processor speed to determine whether it is time to recheck the signal. If yes, then the process is routed back to step 1102 for rechecking of the frequency power levels. If it is not time to recheck the signal, then control is routed back to conditional block 1114 to again verify whether the BTS signal is still valid.

The present invention is also readily applicable to radar applications. Current radar antenna systems generally utilize either planar element arrays or parabolic reflector dishes.

To implement 360-degree coverage, the radar antenna is then mechanically rotated. In some implementations, the radar beam is electronically scanned, to thereby increase dwell time over the target. However, electronic scanning over 360 degrees is generally not used. Mechanical rotation of the antenna, has (among others) two undesirable side effects. First, the motor used to drive the rotation is typically a higher failure rate component. Second, the mechanically rotated antenna is affected by external factors such as wind, and the like. Such factors can cause for non-uniform rotation, and thus affect the overall accuracy of the radar unit. The present invention is a cost-effective circular antenna that additionally provides the gain required for radar applications. The switching of the feed elements via solid state electronics provides 360 degree scanning with a uniform beam pattern, but without moving parts.

The artificial dielectric lens antenna is employed as a series of fixed and selectable high gain apertures, as the basis of primary and/or secondary radar. Each individual aperture is fixed (i.e. non-scanning) similar to a conventional planar radar array. The parasitic director array of the present invention allows placement of multiple beams close together with high gain. Per current radar techniques, two adjacent beams are fed by a variety of techniques (e.g. phase shift, time delay, complex amplitude, and the like) to electronically scan a beam between two adjacent beams. With two feed points, the signals can either be fed in phase, or out of phase. If the signals are fed out of phase, then a null point is generated straight-ahead, and the antenna can be used for direction finding. Radar devices typically work off of a sum-and-difference pattern, whereby two feed points are combined to provide a higher gain between them by adding the signals in phase. Any two feedpoints that are 180 degrees out of phase will create an exact null between them. By subtracting what occurs between the two different states, a direction finding ability is created between the two elements. Hence, if the radius of coverage for a particular element is divided up into 10-degree increments, then rather than guessing where a target is within that 10 degrees, the aforementioned technique allows the direction to be further derived to within a fraction of the beamwidth. The accuracy of the device is thereby enhanced by an order of magnitude. Notably, an analog radar dish can move to an infinite number of positions, but the present electronic system can provide similar coverage and discriminate to very fine increments around the 360-degree radius, even if the feed elements are spaced apart by a certain number of degrees (e.g. 10 degrees, with 36 feed elements around the periphery).

Figure 12:
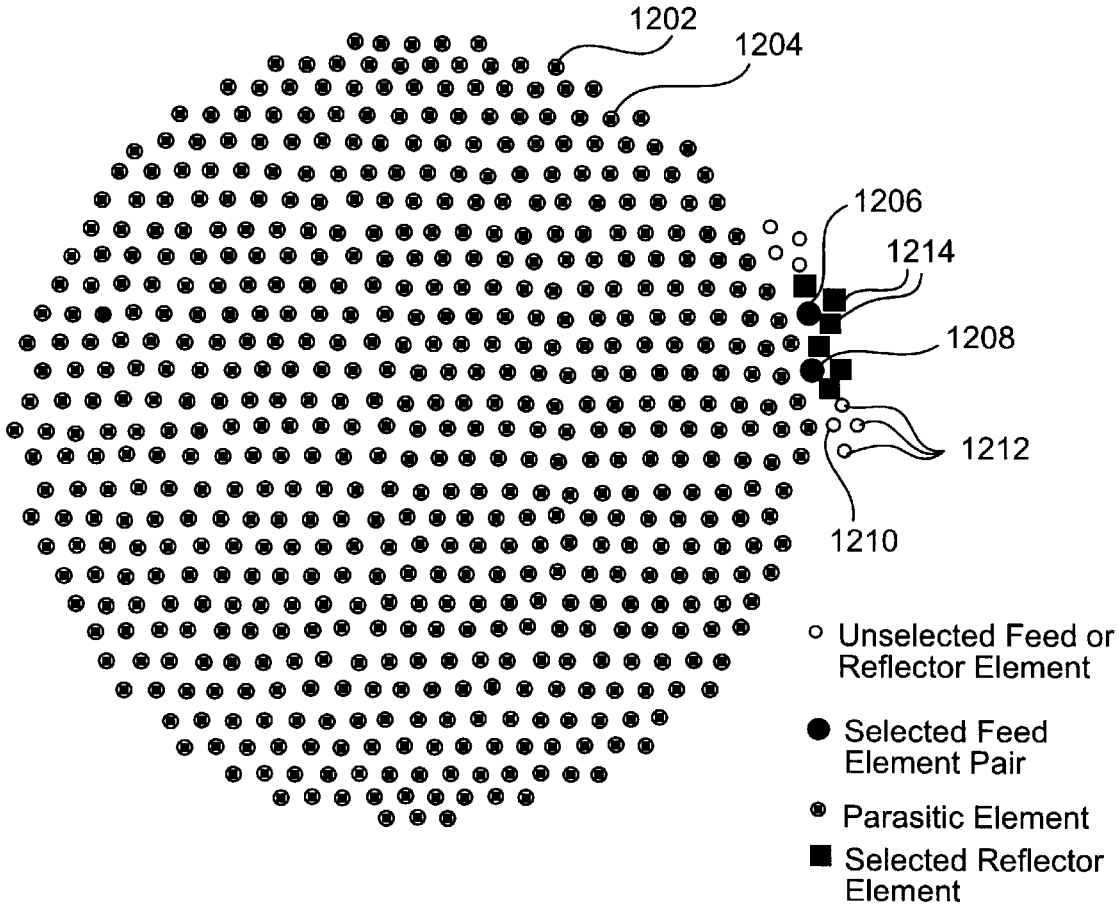
FIG. 12 shows an example antenna element arrangement which might be used in radar applications, according to one aspect of the present invention.

Referring now to FIG. 12, a representative array configuration is shown for radar applications. A collection of parasitic elements 1202, 1204, etc. are arranged in a circular (or other type) pattern to form the parasitic lens area. A plurality of feeds are arranged around the periphery of the parasitic array, and each feed can have reflector elements associated with it. An example of an unselected feed element is shown as 1210, and associated reflector elements 1212 are shown arranged around the feed element. A pair of selected feed elements 1206 and 1208 are shown for generating the adjacent beams. Sets of selected reflector elements, i.e. 1214, are associated with each respective selected feed element.

Depending upon the accuracy required, the radar could process the return signal through any current radar target detection and tracking technique. For instance, first, energy can be received through the same electronically scanned position for approximately one-quarter beam width angle accuracy. Second, the energy can be processed using two adjacent beam positions simultaneously by the creation of sum and difference patterns between the beams for approximately one-tenth beam width angle accuracy. A majority of radars deployed today utilize sum and difference techniques.

A radar assembly typically consists of three major components: 1) an aperture and radome assembly; 2) an RF electronics unit, and 3) a signal and data processing unit. The artificial dielectric lens of the present invention can be used to replace an existing rotated aperture, and a small scan control electronics unit can be incorporated into the RF electronics unit. The aperture and radome assembly can be configured to include fixed beam antennas made of individual driver and reflector sets for each beam, and a common parasitic director array as shared by all beams. The RF electronics unit can include a high powered transmitter, a power splitter, a beam steering network (e.g. phase shift, time shift, complex vector, etc.), the transmit receive switching, the receive RF processing unit, and a down/sampling conversion system. The beam steering network is similar to that employed by other electronically scanned radars. However, a radar utilizing the artificial dielectric lens antenna can scan electronically over 360 degrees, and with sufficient gain. The RF electronics unit typically houses the switching required to utilize the artificial dielectric lens antenna in either a single element or sum/difference mode of operation. The signal and data processing unit provides the digital processing of the waveform and signal to construct information on the backscattered energy, i.e. for weather data, or for collision avoidance, or the like. With the exception of antenna calibration coefficients, the signal and data processing component of the radar is generally unchanged from a radar using a convention aperture.

Figure 13:
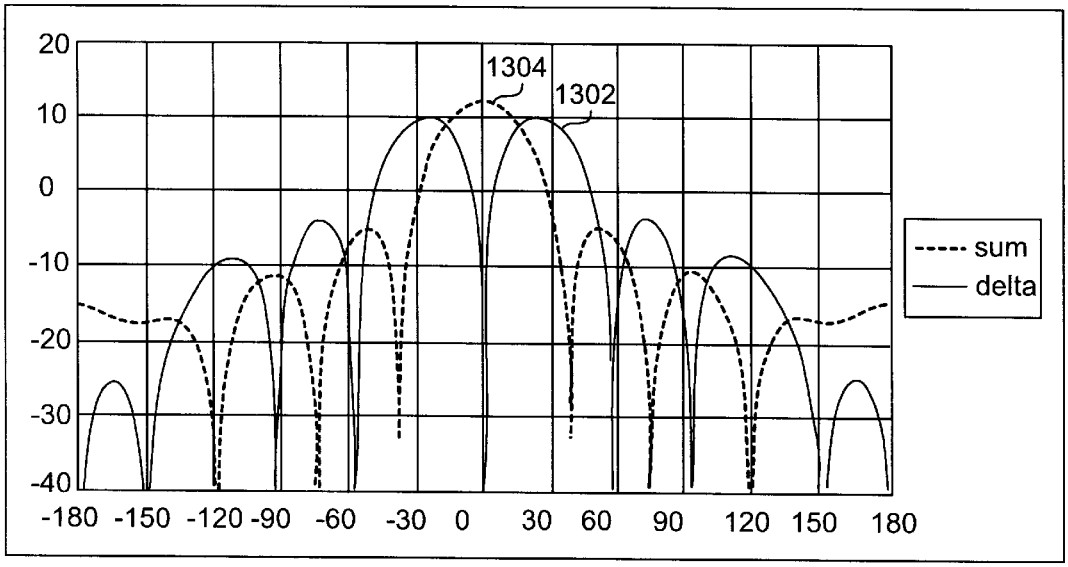
FIG. 13 is a rectangular plot showing sum and difference patterns according to a radar configuration of the present invention.

Referring now to FIG. 13, a typical sum-and-difference plot is shown for the present invention, which is being utilized as a radar device. The gain (dBi) is plotted on the vertical axis, with direction (degrees) on the horizontal axis. The difference (or delta) signal is shown as 1302, and the sum of the signals is shown as 1304. The useful region of this particular pattern would be approximately +/−15 degrees. Notably, if the single "hump" on the summation plot 1304 (as shown between approximately −40 degrees and +40 degrees) is much stronger than the double humps (as shown between approximately −60 and +60 degrees) on the delta plot 1302, then it can be assumed that the source of the signal is close to the pointing angle. By measuring the difference in amplitude and/or phase between the two signals, it can be determined how many degrees off of the pointing angle that source is located. The phase shifting might also be adjusted between the two signals until the result is in the middle, and the result is in a null. This is also referred to as null tracking. Switching between adjacent elements might be accomplished by tracking a certain amount of drop off from the main pattern (e.g. 2 dB), with the appropriate cross-over and phasing adjustments applied accordingly. Null trackers tend to be a relatively inexpensive method of applying radar and/or direction finding, because the antenna is driven (electronically, and/or mechanically) until the target is in the center of the beam.

Figure 14:
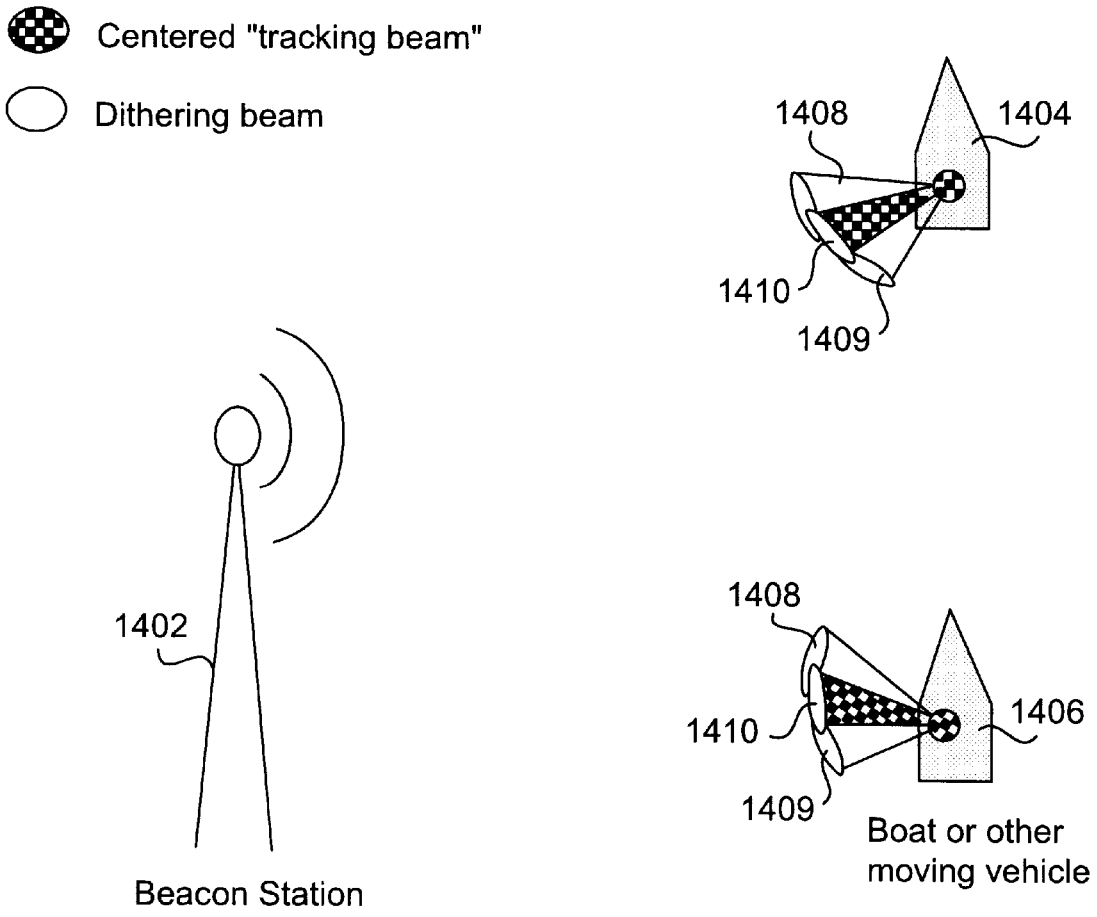
FIG. 14 illustrates usage of the present antenna on moving objects using a centered tracking beam and dithered beams.

The present invention is also readily applicable to moving platforms, provided the analysis and control circuits are fast enough to work on such a moving platform (i.e. an aircraft, car, etc.). Dithering beams are used around a centered tracking beam. Referring now to FIG. 14, a beacon station 1402 is shown transmitting a signal to be received by a mobile platform. A first example is shown of a moving platform (or vehicle) 1404. A centered tracking beam 1410 is oriented towards the beacon station 1402. Dithered beams 1408 and 1409 are used to continually track the beacon station as the vehicle moves in relation to the beacon station. Similar centered and dithering beams are shown for the second example moving platform 1406.

Beam shaping might also be employed by the present invention by strategically using several different elements across the array, in a controlled fashion according to beam shaping theory. Similarly, "smart antennas" might employ the present invention by using multiple elements to shape the beam and create nulls to avoid interference, and the like. Multiple feed points might also be used, and phased appropriately to set a null, which thereby nulls out a jammer or interference source.

Although the foregoing invention has been described in some detail for purposes of clarity of understanding, it will be apparent that certain changes and modifications may be practiced within the scope of the appended claims. Therefore, the described embodiments should be taken as illustrative and not restrictive, and the invention should not be limited to the details given herein but should be defined by the following claims and their full scope of equivalents.

We claim:

1. A directionally controllable dielectric lens antenna device comprising:

at least one switchably selectable feed element forming a feed network;

a switching network for selecting the at least one feed element; and an array of parasitic dielectric director elements arranged to coherently focus incident energy from the at least one selected feed element across the array.

2. The directionally controllable dielectric lens antenna device of claim 1, wherein at least one switchably selectable reflector element is associated with each feed element, and is used to reflect incident energy from the at least one selected feed element back across the array.

3. The directionally controllable dielectric lens antenna device of claim 1, wherein the directional coverage ranges from 0 to 360 degrees.

4. The directionally controllable dielectric lens antenna device of claim 1 wherein the elements include monopole elements.

5. The directionally controllable dielectric lens antenna device of claim 1, wherein the feed elements include a combination of different types of feed elements.

6. The directionally controllable dielectric lens antenna device of claim 5, wherein the feed elements include any one or combination of element types, including monopoles, dipoles, folded dipoles, parasitic monopoles, parasitic dipoles, slot feed elements, or cavity feed elements.

7. The directionally controllable dielectric lens antenna device of claim 1, wherein the elements are spaced apart by a distance of less than or equal to one wavelength.

8. The directionally controllable dielectric lens antenna device of claim 1, wherein the elements are spaced apart by a distance of ⅛ to ¼ wavelength.

9. The directionally controllable dielectric lens antenna device of claim 1, wherein the switching network includes a controllable diode coupled to each feed element.

10. The directionally controllable dielectric lens antenna device of claim 2, wherein a switchable tuning circuit is associated with each feed and/or reflector element.

11. The directionally controllable dielectric lens antenna device of claim 8, wherein the tuning circuit is used to make unselected feed and reflector elements electrically appear as director elements, thereby increasing the size and gain of the parasitic array by adding additional directors.

12. The directionally controllable dielectric lens antenna device of claim 11, wherein the feed and reflector elements are manufactured to different physical sizes in order to make them function as feed and or reflector elements.

13. The directionally controllable dielectric lens antenna device of claim 10, wherein all the elements are manufactured to be relatively the same physical size, and the tuning circuit is used to make any selected feed and/or reflector elements electrically appear as the appropriately sized feed and/or reflector element.

14. The directionally controllable dielectric lens antenna device of claim 13, wherein the tuning circuit switches the unselected feed and reflector elements to ground so that they are director elements.

15. The directionally controllable dielectric lens antenna device of claim 10, wherein the tuning circuit is replaced by a switch which connects unselected feed and/or reflector elements to an open circuit making them electrically invisible.

16. The directionally controllable dielectric lens antenna device of claim 1, wherein the parasitic array is oriented in the center of the antenna device and the feed elements oriented around the periphery of the array.

17. The directionally controllable dielectric lens antenna device of claim 1, wherein the feed elements are oriented in the center of the antenna device, and parasitic array elements are arranged outward from each feed element.

18. The directionally controllable dielectric lens antenna device of claim 1, wherein a plurality of feed elements are simultaneously selected to carry independent feed waveforms, and thereby form a multiple beam antenna.

19. The directionally controllable dielectric lens antenna device of claim 16, wherein a plurality of feed elements are simultaneously selected to carry independent feed waveforms, and thereby form a multiple beam antenna.

20. The directionally controllable dielectric lens antenna device of claim 1, wherein an antenna controller interacts with a receiver to provide commands to the feed network for directional control of the device.

21. The directionally controllable dielectric lens antenna device of claim 20, wherein the receiver is integrally associated with a terminal device which uses the antenna device.

22. The directionally controllable dielectric lens antenna device of claim 20, wherein the receiver is separate from a terminal device which uses the antenna device.

23. The directionally controllable dielectric lens antenna device of claim 1, wherein a switching center is associated with a plurality of base stations and contains logic which is used to determine the optimal directional commands to point antennas that are associated with subscriber terminals interacting with each base station.

24. The directionally controllable dielectric lens antenna device of claim 23, wherein the optimum direction is determined from bandwidth availability among the plurality of base stations.

25. The directionally controllable dielectric lens antenna device of claim 23, wherein the optimum direction is determined from gain availability among the plurality of base stations.

26. The directionally controllable dielectric lens antenna device of claim 1, wherein feed element pairs are selected for feeding signals with relative phase difference to directionally scan the beam.

27. The directionally controllable dielectric lens antenna device of claim 1, wherein the antenna device is used to transmit and receive radar signals.

28. The directionally controllable dielectric lens antenna device of claim 27, wherein feed element pairs are selected for feeding signals out of phase, and comparing sum and differences of the signals.

29. The directionally controllable dielectric lens antenna device of claim 1, wherein the antenna device is associated with a moving platform, and beam control is applied so that a centered tracking beam and dithered beams are utilized to maintain communication between the moving platform and a signal station.

30. The directionally controllable dielectric lens antenna device of claim 23, wherein the antenna device is associated with a moving platform, and beam control is applied so that a centered tracking beam and dithered beams are utilized to maintain communication between the moving platform and a signal station.

31. A directionally controllable dielectric lens antenna device comprising:

a plurality of feed elements arranged to be switchably selected to provide signal coverage in different directions;

a switching network for selecting at least one feed element associated with a signal coverage direction; and an array of parasitic dielectric director elements arranged to coherently focus incident energy associated with the at least one selected feed element across the array.

32. A directionally controllable dielectric lens antenna of claim 31 wherein the elements, including feed, reflector, and parasitic elements, are other than monopole elements, including dipoles, folded dipoles, cavities, and slots.

33. A directionally controllable dielectric lens antenna of claim 31, wherein the elements, including feed, reflector, and parasitic elements, include any combination of different types of feed elements.

34. A directionally controllable dielectric lens antenna of claim 33, wherein the different types of feed elements include monopoles, dipoles, folded dipoles, parasitic monopoles, parasitic dipoles, slot feed elements, or cavity feed elements.

35. A directionally controllable dielectric lens antenna of claim 31 wherein the elements, including feed, reflector, and/or parasitic elements, are replaced with cross-polarized elements, which provides two separate cross-polarized apertures, whereby the antenna can be employed in applications where diversity transmission or reception is desired.

36. The dielectric lens antenna of claim 35, wherein the two separate cross-polarized apertures include a horizontal aperture and vertical aperture.

37. The dielectric lens antenna of claim 35, wherein the two separate cross-polarized apertures include a slant 45-degree right aperture and a slant 45-degree left aperture.

38. A directionally controllable dielectric lens antenna device, including unidirectional control, comprising:

at least one feed element; and an adjacent array or grid of parasitic dielectric director elements, wherein the at least one feed element is used to excite the adjacent parasitic dielectric director elements which form an artificial dielectric lens to direct the signal from the feed element, and further wherein the at least one feed element is located peripheral to the adjacent array or grid of parasitic dielectric director elements.

39. The directionally controllable dielectric lens antenna device, including unidirectional control, of claim 38, wherein the feed element has associated reflector elements.

40. The directionally controllable dielectric lens antenna device, including unidirectional control, of claim 38, wherein the feed element does not have associated reflector elements.

41. The directionally controllable dielectric lens antenna device, including unidirectional control, of claim 38, wherein the array or grid is least one-dimensional.

42. The directionally controllable dielectric lens antenna device, including unidirectional control, of claim 38, wherein the array or grid is two-dimensional or greater.

43. The directionally controllable or unidirectional dielectric lens antenna of claim 38 wherein the elements, including feed, reflector, and parasitic elements, are other than monopole elements, including dipoles, folded dipoles, cavities, and slots.

44. The directionally controllable or unidirectional dielectric lens antenna of claim 38 wherein the elements, including feed, reflector, and/or parasitic elements, are replaced with cross-polarized elements, which provides two separate cross-polarized apertures, whereby the antenna can be employed in applications where diversity transmission or reception is desired.

45. The dielectric lens antenna of claim 44, wherein the two separate cross-polarized apertures include a horizontal aperture and vertical aperture.

46. The dielectric lens antenna of claim 44, wherein the two separate cross-polarized apertures include a slant 45-degree right aperture and a slant 45-degree left aperture.

47. A static directional dielectric lens antenna device comprising:

at least one static feed element; and an array of parasitic dielectric director elements arranged to coherently focus incident energy from the at least one static feed element across the array, wherein the at least one static feed element is located peripheral to the array of parasitic dielectric director elements.

* * * * *